US008643556B2

(12) United States Patent
Lindenmeier et al.

(10) Patent No.: US 8,643,556 B2
(45) Date of Patent: Feb. 4, 2014

(54) RECEIVING AERIAL FOR CIRCULARLY POLARIZED RADIO SIGNALS

(75) Inventors: Stefan Lindenmeier, Gauting-Buchendorf (DE); Heinz Lindenmeier, Planegg (DE); Jochen Hopf, Haar (DE); Leopold Reiter, Gilching (DE)

(73) Assignee: Delphi Delco Electronics Europe GmbH (DE)

( * ) Notice: Subject to any disclaimer, the term of this patent is extended or adjusted under 35 U.S.C. 154(b) by 338 days.

(21) Appl. No.: 13/091,313

(22) Filed: Apr. 21, 2011

(65) Prior Publication Data

US 2012/0050120 A1 Mar. 1, 2012

(30) Foreign Application Priority Data

Aug. 31, 2010 (DE) ..... 10 2010 035 934

(51) Int. Cl.
*H01Q 11/02* (2006.01)

(52) U.S. Cl.
USPC ..... 343/732; 343/741

(58) Field of Classification Search
USPC ..... 343/732, 741, 799, 853, 742
See application file for complete search history.

(56) References Cited

U.S. PATENT DOCUMENTS

| | | | | |
|---|---|---|---|---|
| 4,555,708 | A * | 11/1985 | Waineo et al. | 343/799 |
| 4,680,548 | A * | 7/1987 | Edelstein et al. | 324/318 |
| 5,977,921 | A * | 11/1999 | Niccolai et al. | 343/741 |
| 8,242,964 | B2 * | 8/2012 | Nishi et al. | 343/711 |
| 2003/0063038 | A1 | 4/2003 | Nakano et al. | |
| 2003/0174098 | A1 | 9/2003 | Noro et al. | |
| 2006/0290581 | A1 * | 12/2006 | Parsche | 343/742 |
| 2009/0046026 | A1 | 2/2009 | Nakano et al. | |
| 2010/0182209 | A1 * | 7/2010 | Nishi et al. | 343/711 |
| 2011/0215978 | A1 | 9/2011 | Lindenmeier et al. | |

FOREIGN PATENT DOCUMENTS

| | | |
|---|---|---|
| EP | 0439677 A2 | 8/1991 |
| EP | 1986269 A1 | 10/2008 |
| EP | 2 034 557 | 3/2009 |

(Continued)

OTHER PUBLICATIONS

European Search Report dated May 9, 2012.

(Continued)

*Primary Examiner* — Thien M Le
(74) *Attorney, Agent, or Firm* — J. Gordon Lewis

(57) ABSTRACT

Aerial for the reception of circularly polarized satellite radio signals comprising at least one substantially horizontally oriented conductor loop arranged over a conductive base surface, having an assembly for electromagnetic excitation of the conductor loop connected to an aerial connection. The conductor loop is designed as a loop emitter by a polygonal or circularly closed loop extending in a horizontal plane of height h above the conductive base surface. The loop emitter forms a resonant structure and is electrically excited by the electromagnetic exciter in such a way that on the loop the current distribution of a travelling line wave occurs in one direction of rotation only, of which the phase difference over one revolution is M*2π, where M is an integer and has at least a value of M=2. To facilitate the vertically oriented fractions of the electromagnetic field, there is at least one emitter which extends vertically at the circumference of the loop emitter and to the conductive base surface and which is electromagnetically coupled to both the loop emitter and the electrically conductive base surface. The height h is lower than ⅕ of the free-space wavelength λ.

20 Claims, 16 Drawing Sheets

(56) References Cited

FOREIGN PATENT DOCUMENTS

| | | |
|---|---|---|
| EP | 2 296 227 | 3/2011 |
| GB | 1105354 A | 3/1968 |
| WO | 97/49142 | 12/1997 |

OTHER PUBLICATIONS

"Mesh Antennas for Dual Polarization", H. Nakano, N. Suzuki, T. Ishii, and J. Yamauchi, IEEE Transactions on Antennas and Propagation, IEEE Service Center, vol. 49, No. 5, May 2001,pp. 715-723.
European Search Report dated Jan. 9, 2012.

* cited by examiner

RECEIVING AERIAL FOR CIRCULARLY POLARIZED RADIO SIGNALS

TECHNICAL FIELD

The invention concerns an aerial for the reception of circularly polarised satellite radio signals.

BACKGROUND OF THE INVENTION

In particular with satellite radio systems, both particularly the economic efficiency with respect to the transmitting power emitted by the satellite and the efficiency of the receiving aerial are important. Satellite radio signals are as a rule transmitted with circularly polarised electromagnetic waves on account of polarisation rotations on the transmission path. Often program contents are transmitted for example in separate frequency bands which are close together in frequency. This happens in the example of SDARS satellite radio at a frequency of approximately 2.33 GHz in two adjacent frequency bands each having a bandwidth of 4 MHz with a distance of 8 MHz between center frequencies. The signals are emitted by different satellites with an electromagnetic wave circularly polarised in one direction. Consequently, aerials circularly polarised in the corresponding direction of rotation are used for reception. Such aerials are known for example from DE-A-4008505 and DE-A-10163793. This satellite radio system is additionally assisted by the emission of terrestrial signals in certain areas in a further frequency band having the same bandwidth and arranged between the two satellite signals. Similar satellite radio systems are being planned at present. The satellites of the global positioning system (GPS) emit waves which are also circularly polarised in one direction at a frequency of about 1575 MHz, so that the above-mentioned aerial forms can be basically designed for this service.

The aerial known from DE-A-4008505 is constructed on a substantially horizontally oriented conductive base surface and consists of crossed horizontal dipoles with dipole halves which are inclined downwardly in a V shape and consist of linear conductor portions and which are mechanically fixed at an azimuthal angle of 90° to each other and mounted at the upper end of a linear vertical conductor attached to the conductive base surface. The aerial known from DE-A-10163793 is also constructed over a generally horizontally oriented conductive base surface and consists of crossed frame structures mounted azimuthally at 90° to each other. In the case of both aerials, to produce the circular polarisation the aerial portions which are spatially offset from each other in each case by 90° are interconnected so as to be shifted in electrical phase by 90° to each other. Patch aerials work in a similar manner. All these aerials according to the state of the art have a lower performance with respect to reception at a low angle of elevation.

These aerial forms are of course suitable for the reception of satellite signals which are emitted by high-earth-orbit satellites—so-called HEOS. However, in particular for satellite radio signals which arrive within a low range of angles of elevation and which are emitted by geostationary satellites—so-called GEOS—an improvement in receiving power and the suppression of cross polarisation, and the improvement of reception of vertically polarised signals emitted by terrestrial transmitters, are desirable.

BRIEF DESCRIPTION OF THE INVENTION

It is therefore the object of the invention to provide an aerial which, depending on its design, can be designed both for particularly high-performance reception of circularly polarised satellite signals arriving at low angles of elevation, and for high-performance reception of satellite signals arriving at higher angles of elevation, with sufficient gain and with high suppression of cross polarisation over a wide range of angles of elevation, where there is also to be in particular the possibility of economic manufacture.

This object is achieved in an aerial according to the introductory part of the main claim by the characterising features of the main claim and the measures proposed in the further claims.

Associated with an aerial according to the invention is the invention's advantage of also enabling the reception of linearly vertically polarised waves received at low elevation with an azimuthally nearly homogeneous directional diagram with particularly high gain. Furthermore, the aerial can advantageously be designed in combination with the aerials described above and known from DE-A-4008505 and DE-A-10163793 as well as with patch aerials according to the state of the art, to form a directional aerial with a variable or dynamically trackable azimuthal main direction in the radiation diagram. This advantage will be demonstrated in more detail below. A further advantage of an aerial according to the invention is that it is particularly easy to make, enabling it to be produced even by simple curved sheet metal structures.

According to the invention, the aerial for the reception of circularly polarised satellite radio signals comprises at least one substantially horizontally oriented conductor loop arranged over a conductive base surface 6, having an assembly connected to an aerial connection 5 for electromagnetic excitation 3 of the conductor loop. The conductor loop is designed as a loop emitter 2 by a polygonal or circularly closed loop, extending in a horizontal plane of height h above the conductive base surface 6. The loop emitter 2 forms a resonant structure and is electrically excited by the electromagnetic exciter 3 in such a way that on the loop the current distribution of a travelling line wave occurs in one direction of rotation, of which the phase difference over the developed length of the loop structure is $M*2\pi$. Here, M is at least two and is an integer. For the technically particularly interesting value of M=2, the particularly high radiation gain for circular polarisation for low angles of elevation is obtained compared with the above aerials according to the state of the art. To assist the vertically oriented fractions of the electromagnetic field, there is at least one emitter 4 which is vertical on the loop emitter 2 and extends to the conductive base surface and which is electromagnetically coupled to both the loop emitter 2 and the electrically conductive base surface 6. To generate a pure line wave, the height h is preferably to be selected lower than ⅕ of the free-space wavelength $\lambda$.

The manufacturing tolerances required for aerials according to the present invention can in an advantageous manner be observed substantially more easily. A further very important advantage of the present invention arises from the property that, in addition to the horizontally polarised loop emitter 2, at least one loop coupling point 7 there is a further emitter 4 which has a polarisation oriented perpendicularly to the polarisation of the loop emitter 2. This emitter can, if there are signals emitted with terrestrial vertical polarisation, advantageously also be used for the reception of these signals.

BRIEF DESCRIPTION OF THE DRAWINGS

The invention will be described in more detail below with the aid of practical examples. The associated figures show in detail:

FIGS. 12*a* and 12*b*: are profile views of a loop emitter 2 in an open-topped cavity 38 which is designed e.g. for the purpose of integration in a vehicle body by shaping the conductive base surface 6. The height h1 denotes the depth of the cavity, and the height h the distance of the loop emitter 2 above the cavity base surface 39. Too small a distance 41 between the loop emitter 2 and the cavity side surfaces has the effect of narrowing the frequency bandwidth of the aerial 1, wherein FIG. 12*a* depicts h>h1: partial integration and FIG. 12*b* depicts h=h1: complete integration;

Figure 1:
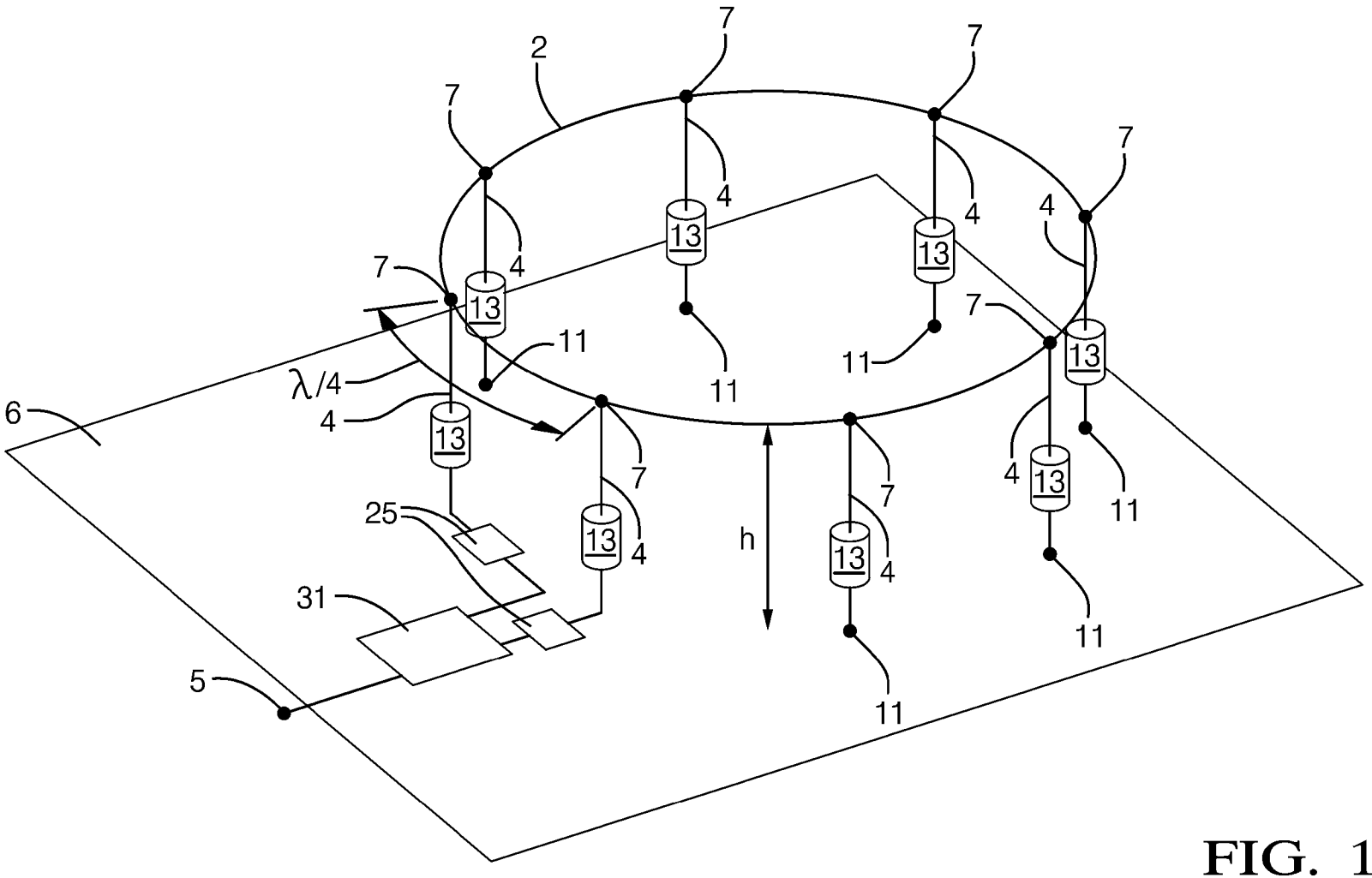
FIG. 1: is an aerial according to the invention having a circular loop emitter 2 designed as a resonant structure for generating a circularly polarised field with azimuthally dependent phase with an electromagnetic exciter 3 which is provided by the delivery, at loop coupling points 7 spaced apart from each other by λ/4, of signals which differ in phase by 90°, to generate a rotating wave with one wavelength over the circumference of the line. Vertical components of the electrical radiation field are assisted by the vertical emitters 4 which are in each case connected at an interruption point 23 to a low-loss reactance circuit 13 of reactance X.

Corresponding reference characters indicate corresponding parts throughout the several views. Although the drawings represent one or more embodiments of the present invention, the drawings are not necessarily to scale and certain features may be exaggerated in order to better illustrate and explain the present invention. The exemplifications set out herein illustrate preferred and alternative embodiments of the invention and such exemplifications are not to be construed as limiting the scope of the invention in any matter.

DETAILED DESCRIPTION OF THE PREFERRED AND ALTERNATIVE EMBODIMENTS OF THE INVENTION

The loop emitter 2 of the invention is designed as a passive resonant structure for a transmitting or receiving aerial, which allows the emission or reception of substantially circularly polarised waves within a range of angles of elevation between $\theta=20°$ (vertical) and $\theta=70°$ and substantially vertically polarised waves within a range of angles of elevation between $\theta=90°$ and $\theta=85°$, where $\theta$ describes the angle of the incident wave relative to the vertical. In general here it is desired that omnidirectional emission is azimuthal.

The distribution of currents on an aerial in the reception mode is dependent on the terminating resistance at the aerial connection point. By contrast, in the transmission mode the distribution of currents on the aerial conductors, referred to the supply current at the aerial connection point, is independent of the source resistance of the feed-in signal source and is therefore clearly linked to the directional diagram and the polarisation of the aerial. On account of this clarity in connection with the law of reciprocity whereby the emission properties—such as directional diagram and polarisation—are identical in transmission and reception modes, the object of the invention is achieved with respect to polarisation and radiation diagrams by designing the aerial structure to generate corresponding currents in the transmission mode of the aerial. By this means the object of the invention is also achieved for the reception mode. All considerations of currents on the aerial structure and their phases or their phase reference points hereafter therefore refer to reciprocal operation of the receiving aerial as a transmitting aerial, unless the reception mode is expressly stated.

FIG. 1 shows the basic shape of an aerial according to the invention with a circular loop emitter 2 designed as a resonant structure for generating a circularly polarised field. To generate the resonance, the developed length of the loop in a basic shape of the loop emitter 2 is selected so as to substantially correspond to an integral multiple of the full line wavelength, that is, $M*\lambda$, where M is an integer and M assumes at least a value of 2. An aerial of this kind has the particular advantage that for example for a value of M=2 for low angles of elevation a comparatively particularly high gain can be obtained when receiving circularly polarised waves. This property is particularly important for the reception of geostationary satellite signals.

A further advantage of an aerial of this kind lies in that the phase of circular polarisation is rotated with the azimuthal angle of the propagation factor in M-fold and hence in at least 2-fold dependence. Thus an aerial of this kind can be combined with a crossed emitter 24 with the same centre Z according to the state of the art to form a directional aerial with azimuthal main direction. The directivity with azimuthal main direction in this case results from combining the radiation diagram of the crossed emitter 24 with simple dependence of phase on the azimuthal and radiation diagram of the loop emitter. By superimposing on the received signals of the crossed emitter 24 the received signals of the loop emitter 2, of which the phase of circular polarisation is rotated with the azimuthal angle of the propagation vector in M-fold dependence, the directional aerial with a directional diagram with azimuthal main direction can easily be formed. Crossed emitters 24 of this kind are, as already stated above, known for example from DE-A-4008505 and DE-A-10163793. The aerial known from DE-A-4008505 is constructed on a substantially horizontally oriented conductive base surface and consists of crossed horizontal dipoles which are mechanically fixed at an azimuthal angle of 90° to each other and mounted at the upper end of a linear vertical conductor attached to the conductive base surface. The aerial known from DE-A-10163793 is also constructed on a generally horizontally oriented conductive base surface and consists of crossed frame structures mounted azimuthally at 90° to each other. In the case of both aerials, to produce the circular polarisation the aerial portions which are spatially offset from each other by 90° are connected so as to be shifted in electrical phase by 90° from each other. The manner of operation of all these crossed emitters is essentially based on the fact that the individual aerial portions are placed on planes which are "crossed" at right angles and perpendicular to the base plane, and the aerial portions of the different planes are connected so as to be offset in phase by 90° to produce the circular polarisation. The action of patch aerials can be presented in a similar manner as well. All these aerials with azimuthal omnidirectional diagram mentioned here, which are composed of two crossed emitters and of which the polarisation is circular, have the property that their phase of circular polarisation rotates with the azimuthal angle of the propagation vector in single dependence. They are therefore here referred to as "crossed emitters" to distinguish them easily. In particular for use on vehicles, the compatibility of an aerial system is particularly important. Aerial systems are frequently optionally designed as single-aerial systems and as aerial diversity systems. A loop emitter 2 according to the invention here has the particular advantage that it can be provided as the basic shape for a single-aerial system, which can be made up by additionally fitting a crossed emitter—such as for example from DE-A-10163793, DE-A-4008505 or as a readily available patch aerial—into a directional aerial capable of tracking in the main direction of radiation, or into an aerial diversity system.

The loop emitter 2 is designed to extend in a horizontal plane of height h above the conductive base surface 6, so that in relation to the conductive base surface 6 it forms an electrical line with an impedance which results from the height h and the effective diameter of the substantially wire-like loop conductor. To produce the desired circular polarisation with azimuthally dependent phase of a direction of rotation of radiation in the far field, it is necessary to excite a line wave propagated in one direction only on the loop emitter 2. This is brought about according to the invention by an electromagnetic exciter 3 which causes the rotating wave of one wavelength over the circumference of the line in one direction of rotation only. For this purpose, signals differing in phase by 90° are supplied in FIG. 1 at loop coupling points 7 spaced apart from each other by $\lambda/4$. Vertical components of the electrical radiation field are facilitated according to the invention by vertical emitters 4 which allow the emission of vertical electrical field portions, and via excitation 3 of the loop emitter 2 in the example shown. The signals which differ in phase by 90° for supply at the bases of the vertical emitters 4 can be generated by way of example by a power divider and phase shifter network 31 and in each case via a corresponding matching network 25.

Figure 2:
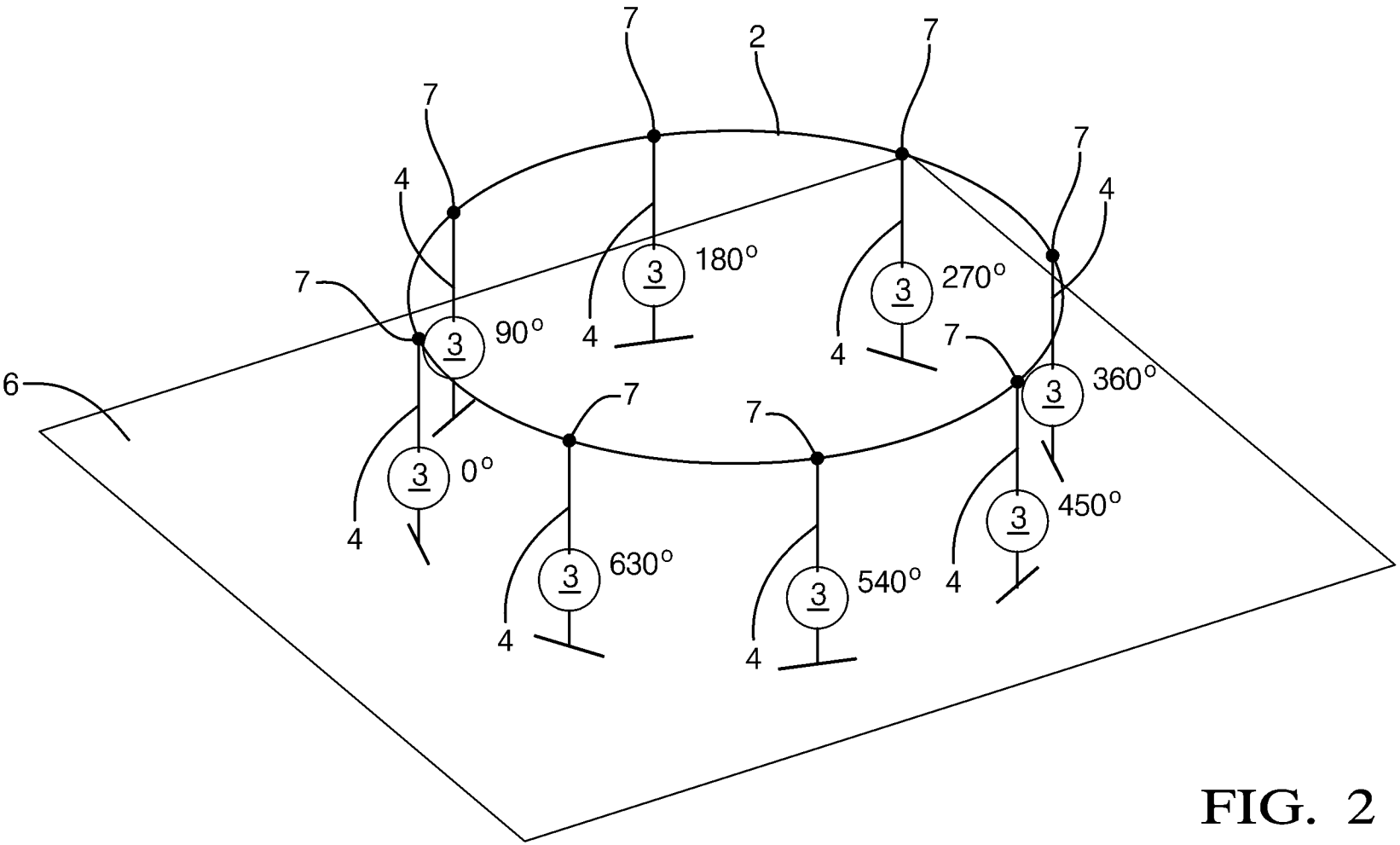
FIG. 2: is a loop emitter 2 by the example where M=2, but with electromagnetic excitation 3 at 8 loop coupling points 7 each offset by λ/4 along the loop, by signals of the power sources which are each offset in phase by 90°. The power sources of the exciter 3 can be obtained in a manner known in the art by power division and 90° hybrid coupler or by a distribution network consisting of a microstrip line.

In a further advantageous embodiment of the invention, in FIG. 2 to generate a continuous line wave with M=2 wavelengths λ on the loop emitter 2, N=8 loop coupling points 7 in each case spaced apart from each other by λ/4 along the closed loop structure are formed, to which vertical emitters 4 are coupled, electrically in the example. Electromagnetic excitation 3 takes place in such a way that between the lower ends of the vertical emitters 4 and the electrically conductive base surface, signals of equal quantity which are in each case shifted in phase by 360°/4 from each other are supplied.

Figure 3:
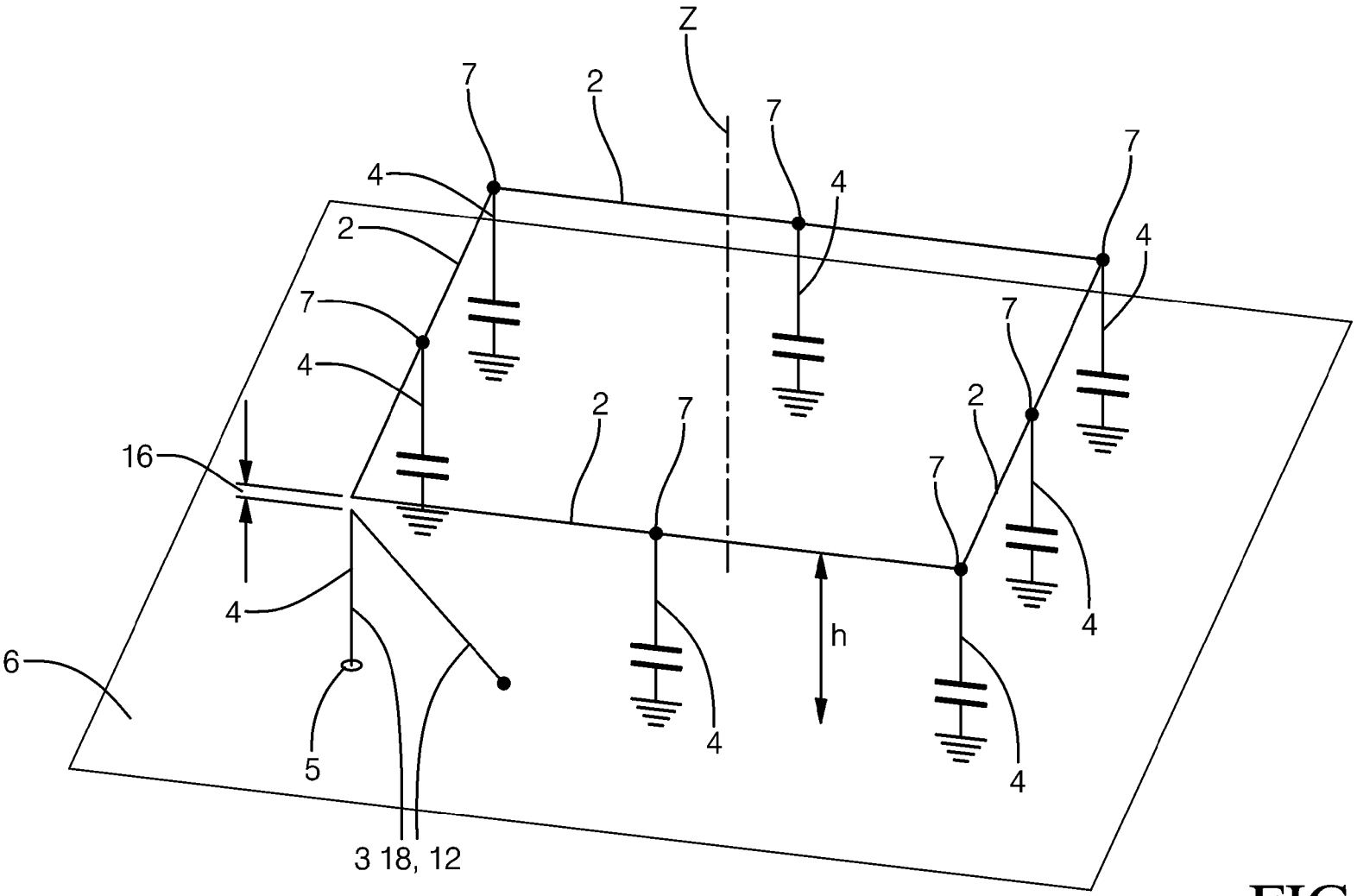
FIG. 3: is an aerial according to the invention with a loop emitter 2 designed as a closed square ring where M=2, with an edge length of 2*λ/4. The excitation 3 is designed as contactless coupling to the loop emitter 2 via the ramp-like λ/4 directional coupling structure 18 with the aerial connection 5. The coupling structure 18 comprises the vertical emitter 4.

In a further advantageous embodiment of the invention, the loop emitter 2 in FIG. 3 where M=2 is designed as a closed square ring with an edge length of substantially 2*λ/4 above the conductive base surface 6 at a distance h above the conductive base surface 6. To generate a continuous line wave on the loop emitter 2 and for coupling to the loop emitter 2, the electromagnetic exciter 3 is designed as a ramp-like directional coupling conductor 12 with an advantageous horizontal extent of essentially λ/4. The latter is essentially designed as a linear conductor advantageously extending in a plane which contains one side of the loop emitter 2 and which is oriented perpendicularly to the electrically conductive base surface 6. In this case the linear conductor, starting from the aerial connection 5 located on the conductive base surface 6, extends via a vertical feed wire 4, except for a coupling distance 16, to one of the corners of the loop emitter 2, and from there extends essentially according to a ramp function more or less below an adjacent corner to the base surface 6, and is conductively connected to the latter via the earth connection 11. By adjustment of the coupling distance 16, matching at the aerial connection 5 can easily be achieved. The particular advantage of this arrangement lies in contactless coupling of the exciter 3 to the square-shaped loop emitter 2, which according to the invention allows particularly easy manufacture of the aerial.

Particularly advantageous embodiments of aerials according to the invention are those arrangements in which loop coupling points 7 are formed on the loop emitter 2 of developed length L at substantially similar intervals L/N from each other, and coupled to them is in each case a vertical emitter 4, which on the other hand are coupled by earth connection points 11 to the electrically conductive base surface 6. To generate a line wave which is propagated in one direction only on the loop emitter 2, according to the invention it is particularly advantageous to insert reactance circuits 13 at interruption points in the vertical emitters 4, in order to fix the direction of propagation of this wave by designing its reactance X, and to prevent propagation of a wave in the opposite direction thereto.

Figure 4:
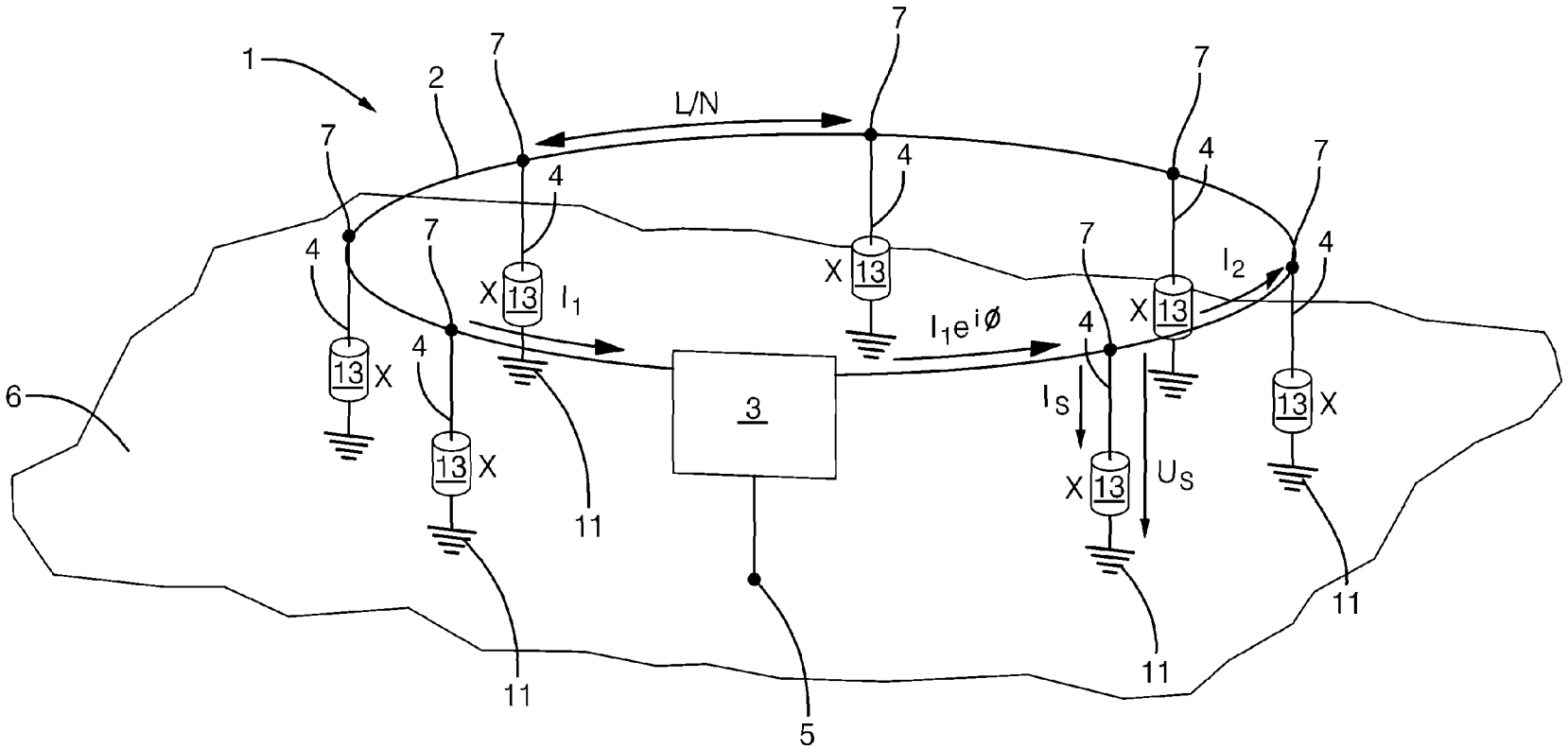
FIG. 4: Aerial according to the invention, by way of example with a circular loop emitter 2 with exciter 3 shown generally and with loop coupling points 7 arranged equidistantly at the circumference, with vertical emitters 4 which are coupled thereto and to which are connected, at interruption points, low-loss reactance circuits 13 with the different reactances X necessary to generate a rotating current wave on the loop emitter 2. Due to the design of the reactances X, it is possible to make the sections L/N shorter by a shortening factor of k<1 than corresponds to the value L/N=M*λ/N, so that it is more true that L/N=k*M*λ/N.

FIG. 4 shows an arrangement of this kind in which the exciter 3, which can be of diverse design, is shown in a general form. By electromagnetic coupling, that is, preferably galvanic or capacitive coupling of the aerial portions, consisting of the loop structure 2 and the circular group of vertical emitters 4 at the loop coupling points 7, the aerial portions are coupled together in such a way that the aerial portions structurally contribute to a circularly polarised field. The loop emitter 2 in this case acts as an emitting element which generates a circularly polarised field with a main direction of radiation at medium angles of elevation. The electromagnetic field generated by the vertical emitters 4 is superimposed on this field. In the process the electromagnetic field generated by the circular group of vertical emitters 4 with diagonal elevation is also circularly polarised with a main direction of radiation substantially independent of the azimuth. With a very low elevation, this field is vertically polarised and is substantially also azimuthally independent.

Below, the manner of operation of the resonant structure according to the invention is described in more detail with the aid of FIG. 4. As already described above, the resonant structure is connected via an exciter 3 to the aerial connection 5 in such a way that the line wave on the loop emitter 2 is propagated substantially in one direction of rotation only, so that a period of the line wave is contained in the direction of rotation of the ring structure.

The ring structure with N vertical emitters can be divided into N segments. As a condition of a continuous wave with a period in the direction of rotation, the following applies to the currents I2 and I1 of adjacent segments:

$$\underline{I2}=\underline{I1}\cdot\exp(jM2\pi/N) \tag{1}$$

Furthermore, the following applies to the current at the loop coupling point 7 which flows into the vertical emitter 4:

$$\underline{IS}=\underline{I1}\cdot\exp(j\Phi)-\underline{I2}, \quad \text{(2) and}$$

$$\text{where } \Phi=2\pi L/(N\lambda) \tag{3}$$

forms the phase rotation over the waveguide of length L/N for one segment. Hence the current IS must be adjusted via the impedance of the vertical emitter 4 together with the reactance X at the base connection point of the vertical emitter 4 in such a way that the following applies:

$$\underline{IS}=\underline{I1}\cdot[\exp(j2\pi L/(N\lambda))-\exp(jM2\pi/N)] \tag{4}$$

The vertical emitters 4 together with the reactances X form in their equivalent circuit a filter consisting of a series inductance, a parallel capacitance and a further series inductance. The parallel capacitance is selected by adjustment of the reactances X in such a way that the filter is matched on both sides to the conductor impedance of the ring-shaped line. The resonant structure therefore consists of N conductor segments of length L/N and in each case a filter connected thereto. Each filter causes phase rotation ΔΦ. The length L/N of the conductor segments is then adjusted in such a way that over this conductor segment a phase rotation of $$\Phi=2\pi L/(N\lambda) \tag{5}$$

occurs according to equation (3), which together with the phase rotation ΔΦ|| of the corresponding filter produces a resulting phase rotation over a segment of $$\Delta\Phi+\Phi=M2\pi/N \tag{6}$$

The electromagnetic wave which is propagated in the direction of rotation along the ring structure thus undergoes, on rotation, the phase rotation of M*2π. With this particularly advantageous embodiment of the invention, there is thus the possibility of making the developed length L of the loop aerial 2 shorter by a shortening factor of k<1 than M times the wavelength λ, so that L=k*M*λ.

Observing the condition indicated in equation 4 for the current in the vertical emitters 4 according to the invention results in their structural contribution to circular polarisation in diagonal and even lower elevation with azimuthal omnidirectional characteristic. This yields the particular advantage of the principal radiation with circular polarisation at lower elevation with the present invention. Thus the aerial is also particularly suitable for the reception of signals of low-earth-orbit satellites. Also, the aerial can advantageously be used for satellite radio systems in which terrestrially, vertically polarised signals are emitted in addition to facilitate reception.

Figure 5:
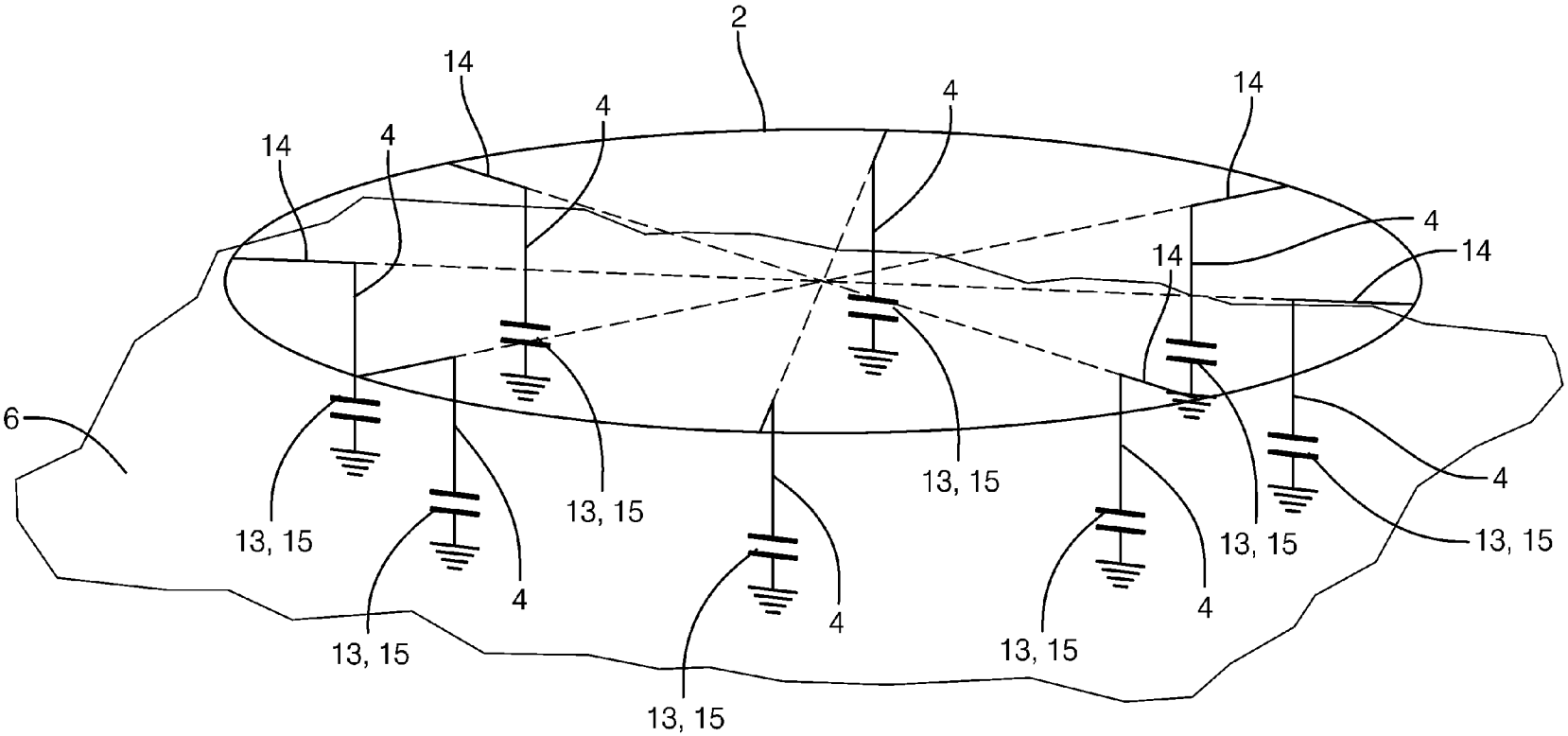
FIG. 5: is an aerial according to the invention as in FIG. 4, but with horizontal additional elements for further shaping of the directional diagram.

In a further, advantageous embodiment of the invention, the vertical emitters 4 as in FIG. 5 are coupled via horizontal emitter elements 14 to the loop coupling points 7. The horizontal emitter elements 14 can be used flexibly for further shaping of the vertical radiation diagram of the aerial. The requirement of choice of reactances X to be introduced into the vertical emitters 4 to fulfil the above equations, as described above, remains unaffected.

Figure 6:
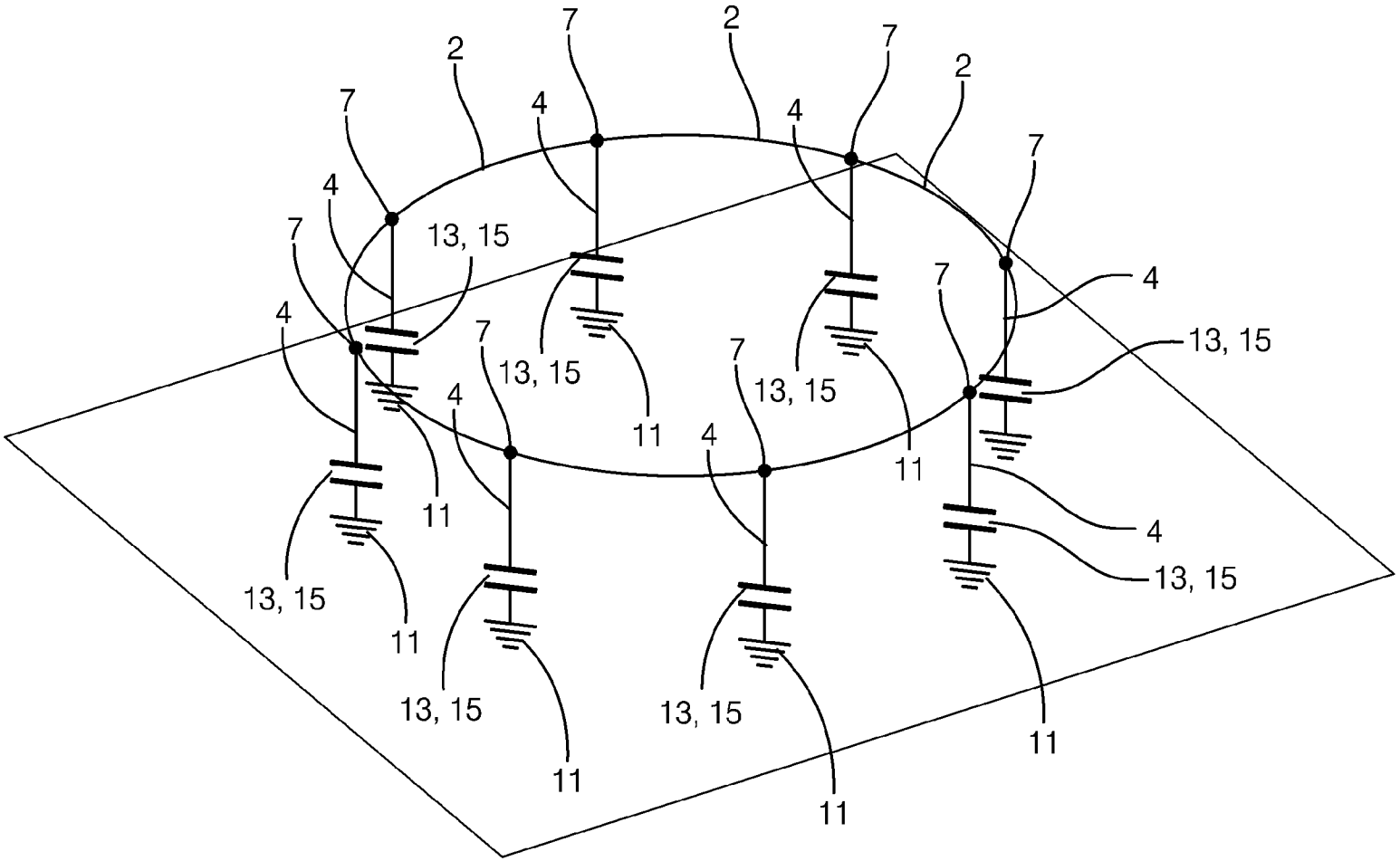
FIG. 6: is an aerial according to the invention where M=2 with a particularly advantageous circular embodiment of the loop emitter 2, with vertical emitters 4 distributed substantially equidistantly over the circumference. The exciter 3 which can be designed in different ways is not shown.

Particularly suitable for perfecting omnidirectional emission of a loop emitter 2 is the circular structure shown in FIG. 6 with loop coupling points 7 formed equidistantly over the circumference of the loop emitter 2, and with vertical emitters 4 electrically connected there, each with a capacitance 15 introduced at the base to the earth connection point 11 as a reactance circuit 13. The exciter 3 for this resonant structure can be designed in various ways and is therefore not shown in FIG. 6.

Figure 7:
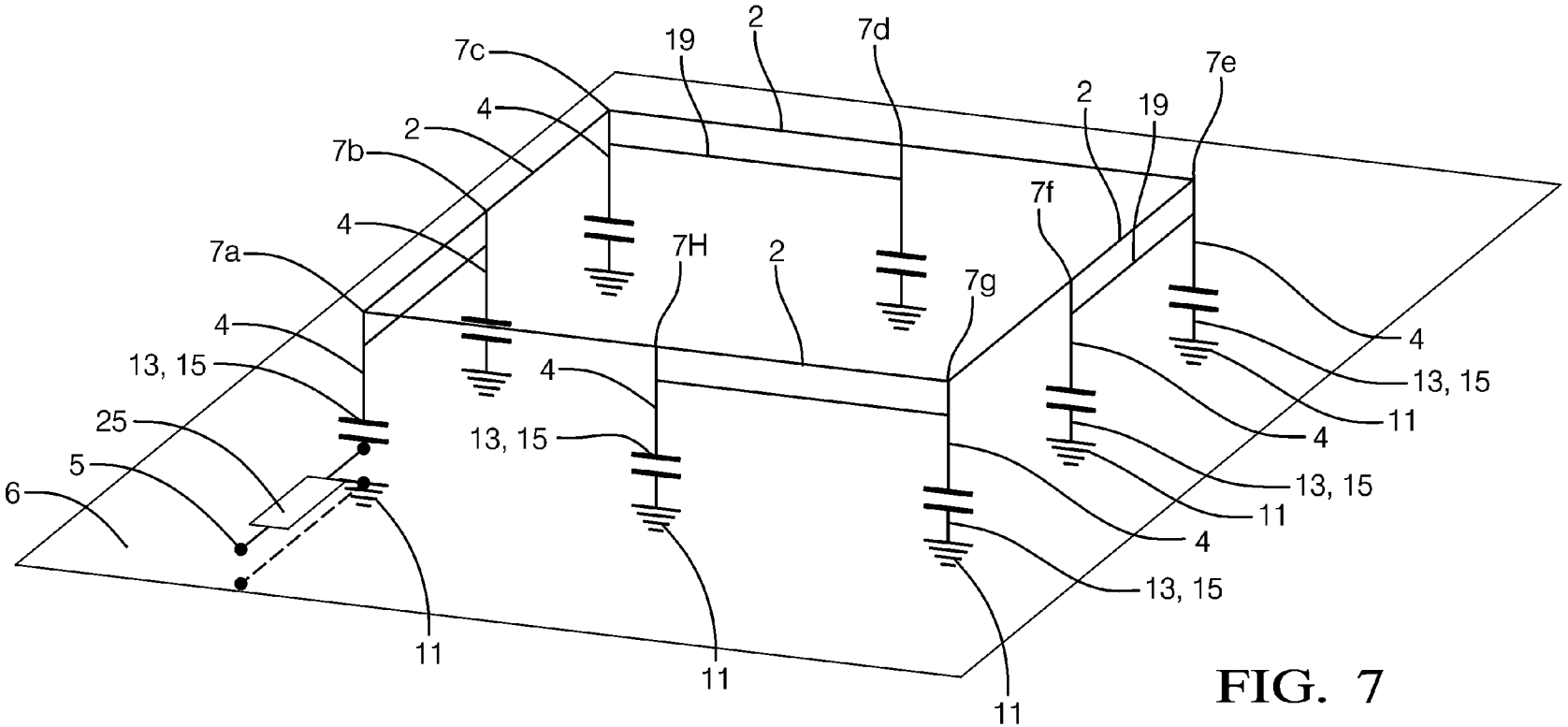
FIG. 7: is an aerial according to the invention with a rectangularly shaped emitter as in FIG. 3, but with electromagnetic excitation 3 by supply at the lower end at one of the vertical emitters 4 via the matching network 25 and via the reactance circuit 13 designed as a capacitance 15. Facilitation of unidirectionality of wave propagation on the loop emitter 2 is achieved by alternately differing design of the impedances of the sections succeeding each other in the direction of rotation between two adjacent loop coupling points 7*a*-7*b* or 7*b*-7*c*, etc. The unidirectionality of wave propagation is finely adjusted by slightly different lengths of the sections.

In FIG. 7 one of the vertical emitters 4 of a rectangularly shaped loop emitter with the reactance circuit 13 designed as a capacitance 15 is coupled not to the earth connection point 11 on the electrically conductive base surface 6, but to the connection to the matching network 25 formed at the level of the conductive base surface 6, and hence to the aerial connection 5. To cause unidirectionality of wave propagation on the loop emitter 2, in this advantageous embodiment of the invention the impedance of the section of the loop emitter 2 to the adjacent loop coupling point 7*b*, referred to the conductive base surface 6, is made different to the impedance of the other sections of the loop emitter 2. With suitable choice of this impedance, the propagation of a line wave in the opposite direction of rotation is suppressed. The impedance can in a known manner be formed for example by choice of the effective diameter of the substantially linear loop emitter 2 or, as shown by way of example, by an additional conductor 19 which reduces the impedance. Facilitation of unidirectionality of wave propagation on the loop emitter 2 is achieved by alternately differing formation of the impedances of the successive sections in the direction of rotation between two adjacent loop coupling points 7*a*-7*b* or 7*b*-7*c*, etc. Fine adjustment of the unidirectionality of wave propagation is similarly effected by a slightly different choice of length of the sections, with length differences between 5 and 10%.

Figure 8:
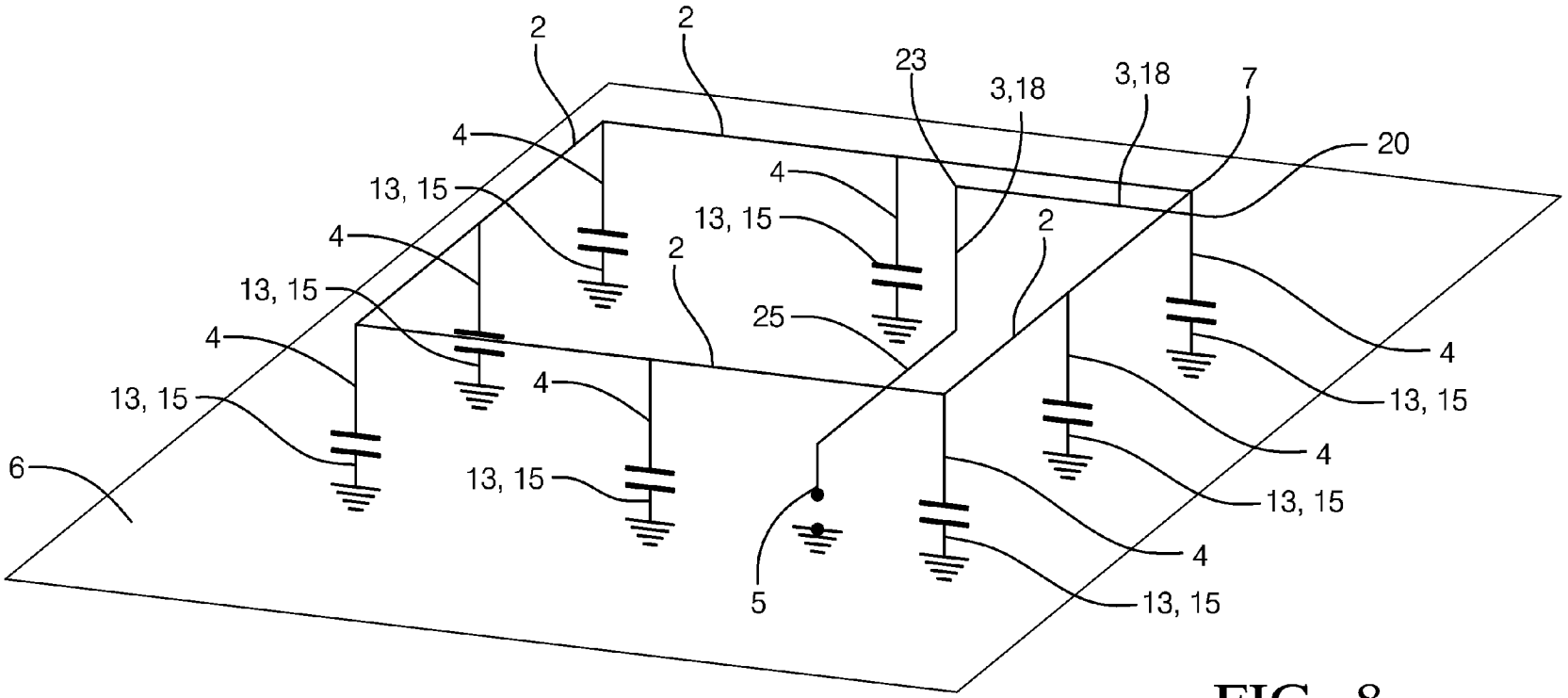
FIG. 8: is an aerial according to the invention as in FIG. 7, wherein the matching network 25 is designed in the form of a high-resistance transmission line laid parallel to the electrically conductive base surface 6 over about ¼ of the wavelength.

In the advantageous embodiment of an aerial according to the invention shown in FIG. 8 where M=2, the electromagnetic exciter 3 is formed by partial coupling 20 to one of the vertical emitters 4 at one of the loop coupling points 7. The unidirectional effect of electromagnetic excitation 3 in relation to wave propagation is provided by partial coupling to a vertical emitter 4 via a coupling conductor 23 which is parallel to part of the loop emitter 2, and the other end of the coupling conductor 23 is connected to a vertical emitter 4*e* extending to the conductive base surface 6, wherein the latter vertical emitter 4*e* is connected via a matching network 25 to the aerial connection 5. The matching network 25 is advantageously constructed in the form of a high-resistance transmission line laid parallel to the electrically conductive base surface 6 over about ¼ of the wavelength.

Figure 9:
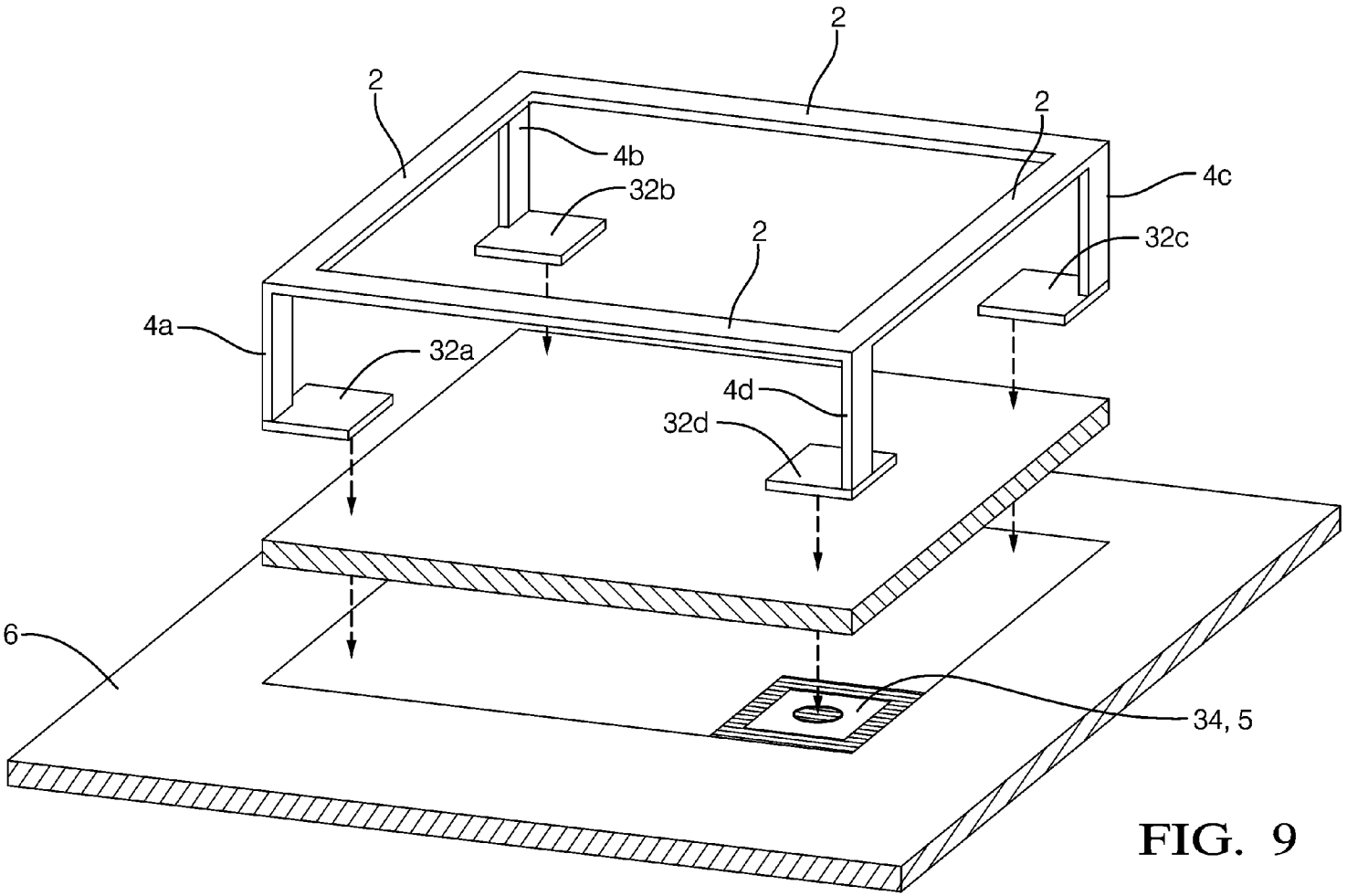
FIG. 9: is an exploded, perspective view of basic structural designs of a loop emitter 2 with vertical emitters and capacitances 15 according to the invention as in FIGS. 3 to 8. The capacitances 15 are formed in such a way that the vertical emitters 4 are formed at their lower ends into individually shaped planar capacitance electrodes 32*a*, 32*b*, 32*c*, 32*d*. By interposition of a dielectric plate 33 located between the latter and the electrically conductive base surface 6 which is constructed as an electrically coated printed circuit board 35, the capacitances 15 are designed for coupling three vertical emitters 4*a*, 4*b*, 4*c* to the electrically conductive base surface 6. For capacitive coupling of the fourth vertical emitter 4*d* to the aerial connection 5, the latter is designed as a planar counterelectrode 34 isolated from the conductive layer.

An essential property of an aerial according to the present invention is the possibility of particularly low-cost manufacture. An outstandingly advantageous form of the aerial in this respect with square loop emitter 2 is in essence designed similarly to FIG. 7 and is shown in FIG. 9 for reasons of clarity with only four vertical emitters 4*a*-4*d*. The loop emitter 2 with the vertical emitters 4*a*, 4*b*, 4*c*, 4*d* can, together with the planar capacitance electrodes 32*a*, 32*b*, 32*c*, 32*d* shaped individually at their lower ends, be made for example from a cohesive, stamped and shaped sheet metal part. The impedances of the sections of the loop emitter 2 can also be formed individually by the choice of width of connecting sections. The electrically conductive base surface 6 is preferably constructed as a conductively coated printed circuit board. The reactance circuits 13 constructed as capacitances 15 are formed in such a way that the capacitance electrodes 32*a*, 32*b*, 32*c*, 32*d* are formed by interposition of a dielectric plate 33 located between them and the electrically conductive base surface 6, for coupling of three vertical emitters 4*a*, 4*b*, 4*c* to the electrically conductive base surface 6. For configuration and for capacitive coupling of the fourth vertical emitter 4*d* to the aerial connection 5, the latter is designed as a planar counterelectrode 34 isolated from the conductive layer of the printed circuit board. At particularly low cost, there is therefore the possibility of producing the essential dimensions necessary for operation of the aerial by a stamped and shaped sheet metal part, with the benefits of being highly reproducible. The sheet metal part, the dielectric plate 33 and the electrically conductive base surface 6 constructed as a printed circuit board can by way of example be connected to each other by low-cost adhesion and therefore without expensive soldering. The connection to a receiver can in a known manner be produced for example by connection of a microstrip line or a coaxial line, starting from the aerial connection 5.

Figure 10:
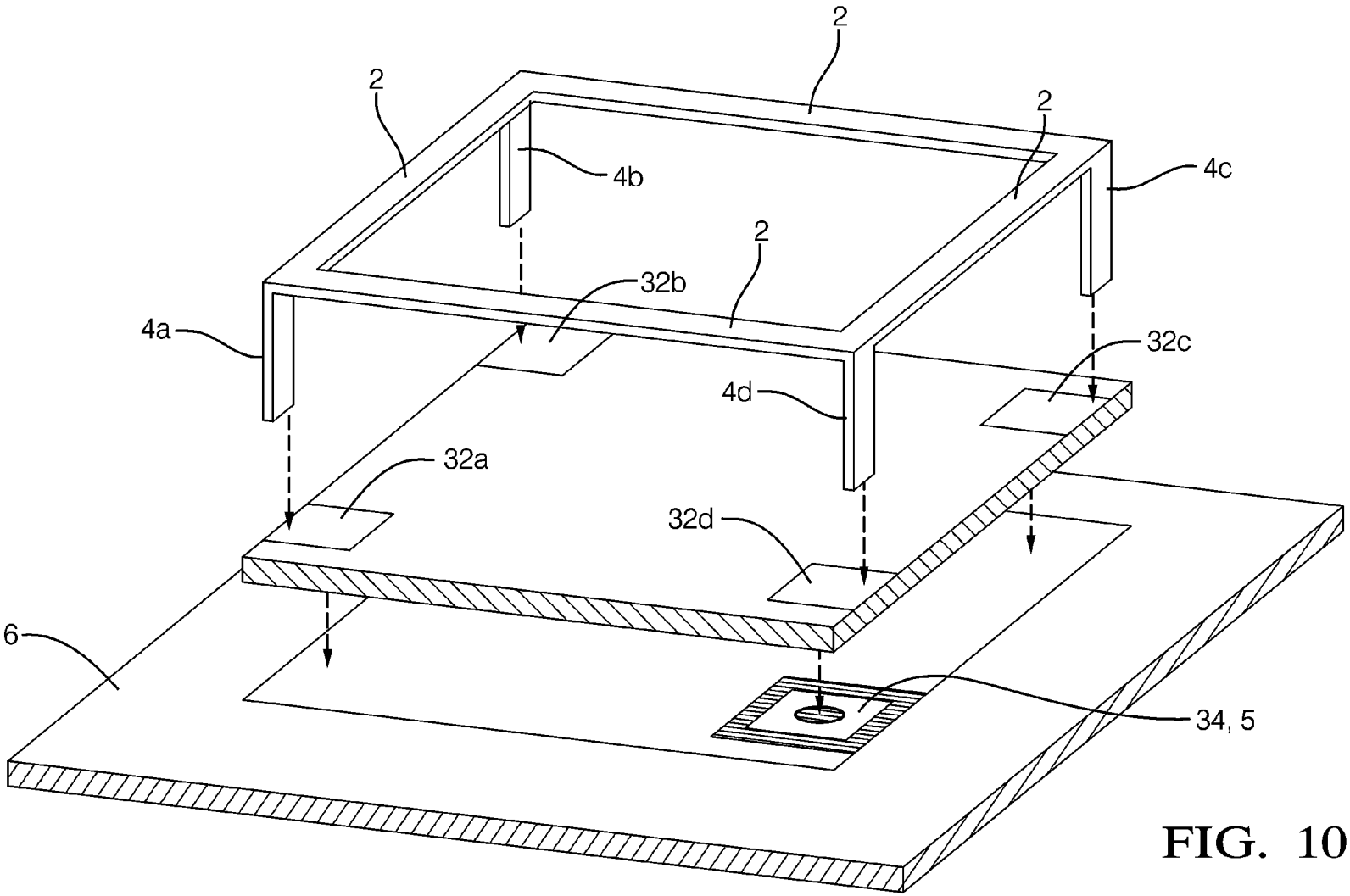
FIG. 10: is an exploded, perspective view of an aerial according to the invention as in FIG. 9. Between the lower ends of the vertical emitters 4*a*, 4*b*, 4*c*, 4*d* and the electrically conductive base surface 6 which is constructed as a conductively coated printed circuit board, a further conductively coated dielectric printed circuit board is inserted. The lower ends of the vertical emitters 4*a*, 4*b*, 4*c*, 4*d* are electrically connected to planar capacitance electrodes 32*a*, 32*b*, 32*c*, 32*d* printed on the upper side of the dielectric printed circuit board, to form the capacitances 15 for capacitive coupling of three of the vertical emitters 4 to the electrically conductive base surface 6. For capacitive coupling of the fourth vertical emitter 4*d* to the aerial connection 5, the latter is designed as a planar counterelectrode 34 isolated from the conductive layer.

In a further variant of the design of an aerial of this kind, in FIG. 10 instead of a dielectric plate 33 between the lower ends of the vertical emitters 4*a*, 4*b*, 4*c*, 4*d* and the electrically conductive base surface 6 constructed as a conductively coated printed circuit board, a further conductively coated, dielectric printed circuit board is inserted. On the upper side of the dielectric printed circuit board there are printed planar capacitance electrodes 32*a*, 32*b*, 32*c*, 32*d* for forming the capacitances 15, which are connected to the vertical emitters 4*a*, 4*b*, 4*c*, 4*d* electrically, if occasion arises by soldering. Capacitive coupling of three of the vertical emitters 4*a*, 4*b*, 4*c* to the electrically conductive base surface 6 is effected via the capacitance electrodes 32*a*, 32*b*, 32*c*. Capacitive coupling of the fourth vertical emitter 4*d* to the aerial connection 5 designed as a planar counterelectrode 34 isolated from the conductive layer is provided via the capacitance electrode 32*d*.

Figure 11:
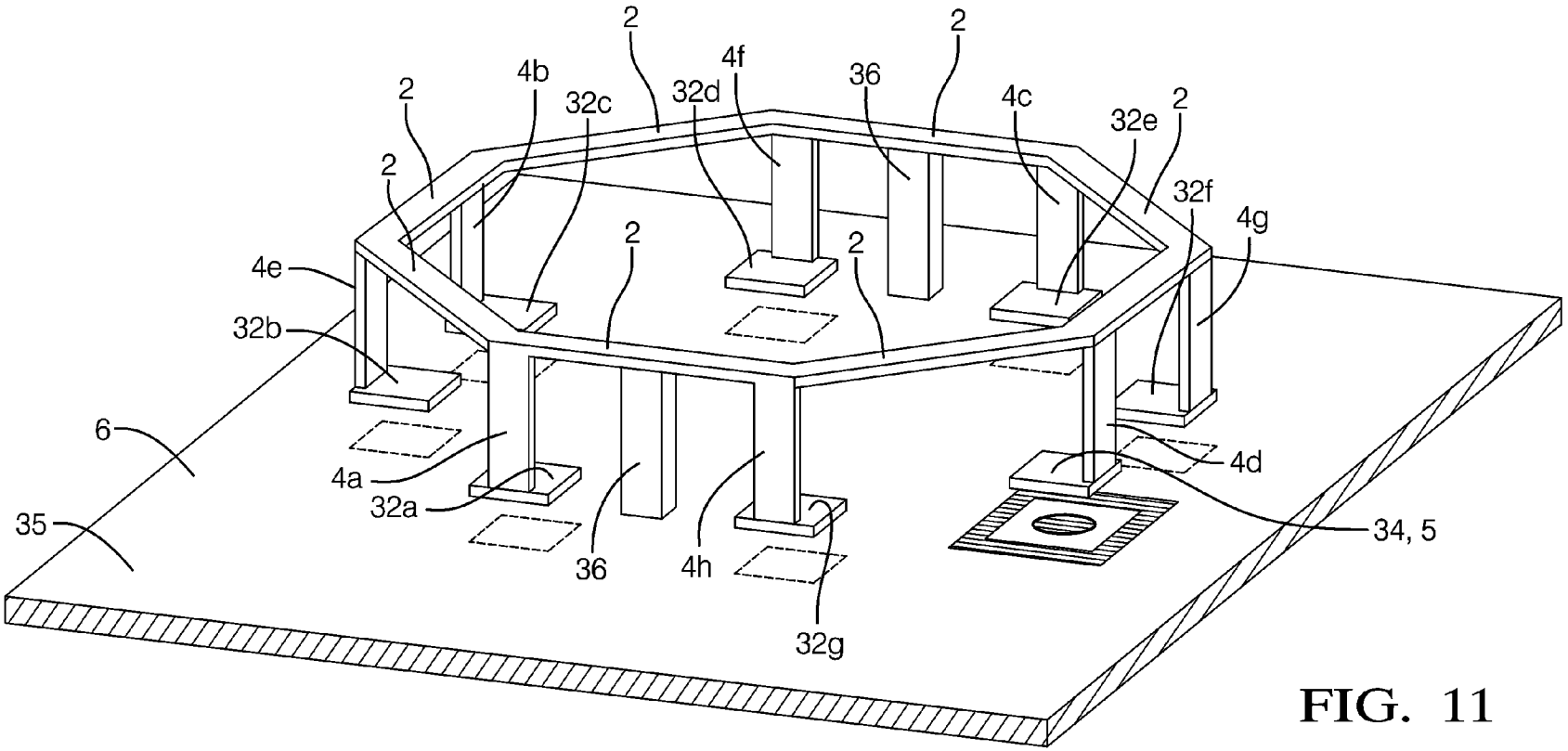
FIG. 11: is an exploded, perspective view of an aerial according to the invention as in FIGS. 11 and 12 where M=2, wherein the conductive structure, consisting of the octagonally shaped loop 2 and the vertical emitters 4 connected thereto, is fixed by a dielectric supporting structure 36 in such a way that in place of the dielectric plate 33 an air gap is produced to form the dielectric.

In FIG. 11 an aerial according to the structural principle shown in FIG. 10 where M=2 is designed, in a further advantageous embodiment of the invention, in such a way that the conductive structure, consisting of the loop 2 designed as an octagon and the vertical emitters 4 connected thereto, is fixed by a dielectric supporting structure 36 in such a way that the dielectric plate 33 is constructed in the form of an air gap.

Figure 12A:
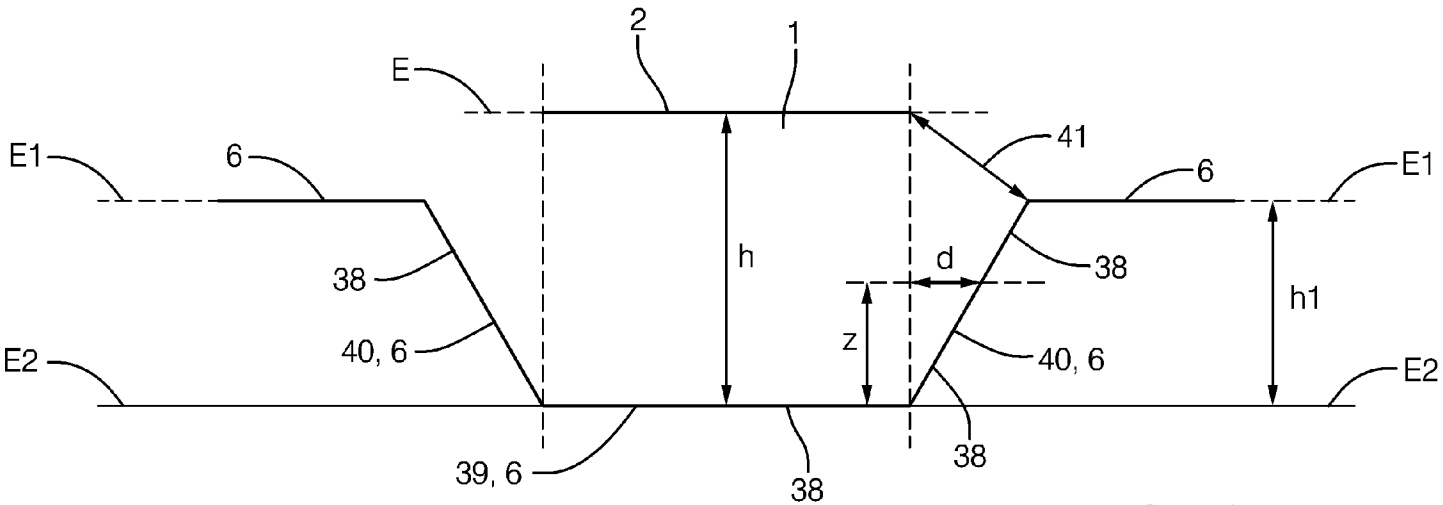
Figure 12B:
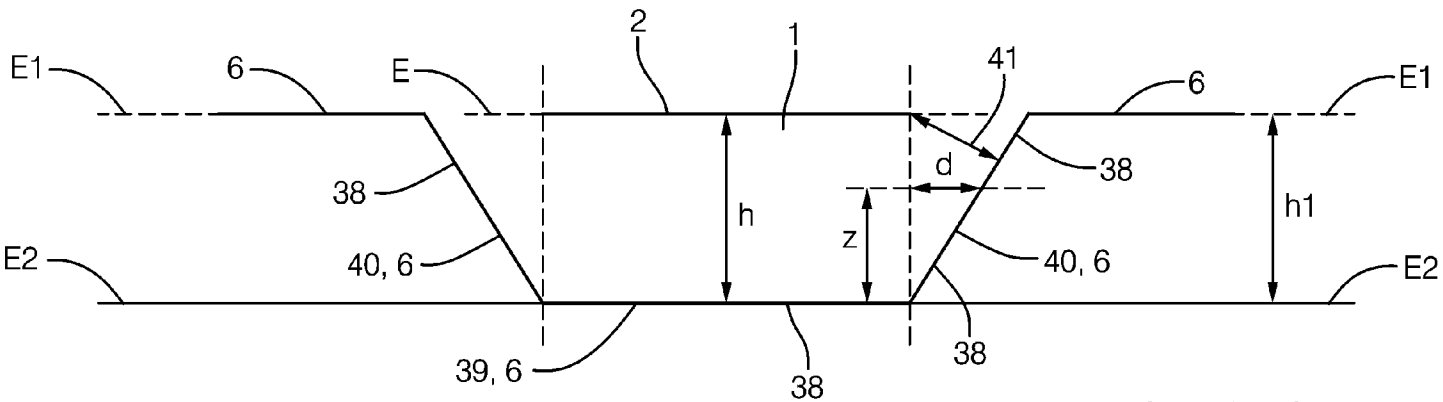

In particular in vehicle manufacture there is frequently an interest in making the visible height of an aerial mounted on the vehicle roof as low as possible. This desire goes as far as designing a completely invisible aerial, the latter being fully integrated in the vehicle roof. In an advantageous embodiment of the invention, as shown in FIGS. 12*a* and 12*b* by way of example in cross-section with oblique cavity side surfaces 40, the conductive base surface 6 extending substantially in a base surface plane E1 at the site of the loop emitter 2 is therefore designed as an open-topped conductive cavity 38. This cavity 38 is thus a working part of the conductive base surface 6 and consists of a cavity base surface 39 in a base surface plane E2 located at a distance h1 parallel to and below the base surface plane E1. The cavity base surface 39 is connected via the cavity side surfaces 40 to the planar part of the conductive base surface 6. The loop emitter 2 is introduced into the cavity 38 in a further horizontal loop plane E at height h extending over the cavity base surface 39.

The environment of the loop emitter 2 with the cavity basically has the effect of narrowing the frequency bandwidth of the aerial 1, which is determined substantially by the cavity distance 41 between the loop emitter 2 and the cavity 38. Therefore the conductive cavity base surface 39 should be at least so great that it at least covers the vertical projection surface of the loop emitter 2 onto the base surface plane E2 extending below the conductive base surface. In an advantageous embodiment of the invention, however, the cavity base surface 39 is larger and selected such that the cavity side surfaces 40 can be designed as vertical surfaces and in the process an adequate cavity distance 41 between the loop emitter 2 and the cavity 38 is provided.

In the event that not enough room is available to form the cavity with vertical cavity side surfaces, it is advantageous to make the base surface plane E2 approximately as great as the vertical projection surface of the loop emitter 2 onto the base surface plane E2 and the cavity side surfaces 40 along a contour which is inclined from a vertical line. In this case the inclination of this contour is to be selected such that, with the required frequency bandwidth of the aerial 1, an adequate cavity distance 41 is provided between the loop emitter 2 and the cavity 38 at each point. In the particularly interesting event of an aerial 1 fully integrated with the vehicle body, shown in FIG. 12*b*, in which the loop plane E extends at approximately the same height as the base surface plane E1, for the above example of SDARS satellite radio with a frequency of about 2.33 GHz in two adjacent frequency bands each with a bandwidth of 4 MHz, approximately the following advantageous dimensioning is produced for observing the necessary cavity distance 41 between the loop emitter 2 and the cavity 38. For this, the inclination of the cavity side surfaces 40 is in each case selected such that, at a vertical distance z above the cavity base surface 39, the horizontal distance d between the vertical connecting line between loop emitter 2 and cavity base surface 39 and the closest cavity side surface 40 assumes at least half the vertical distance z. Naturally there is an increase in the frequency bandwidth of the aerial 1, the wider open the cavity 38 is at the top. If, while observing the last-mentioned necessary cavity distance 41 between the loop emitter 2 and the cavity 38, the cavity side surfaces 40 are made vertical, the necessary frequency bandwidth is similarly ensured. The same also applies if the height h of the loop plane E is greater than the depth of the cavity base surface 39, as shown in FIG. 12*a*. That is to say, h is greater than h1 and the aerial 1 is not fully integrated with the vehicle body.

For the advantageous design of a multi-band aerial according to the invention, the reactance circuit 13 is multi-frequency such that both the resonance of the loop emitter 2 and the required direction of travel of the line wave on the loop emitter 2 are provided in frequency bands separate from each other. In particular for the formation of combination aerials for several radio services, loop emitters 2 according to the present invention afford the advantage that they can be made particularly space-saving. For this purpose for example several loop emitters can be designed for the different frequencies of several radio services about a common centre Z. On account of their different resonant frequencies, the different loop emitters have only little effect on each other, so that minor distances between the loops of the loop emitters 2 can be formed.

Figure 13:
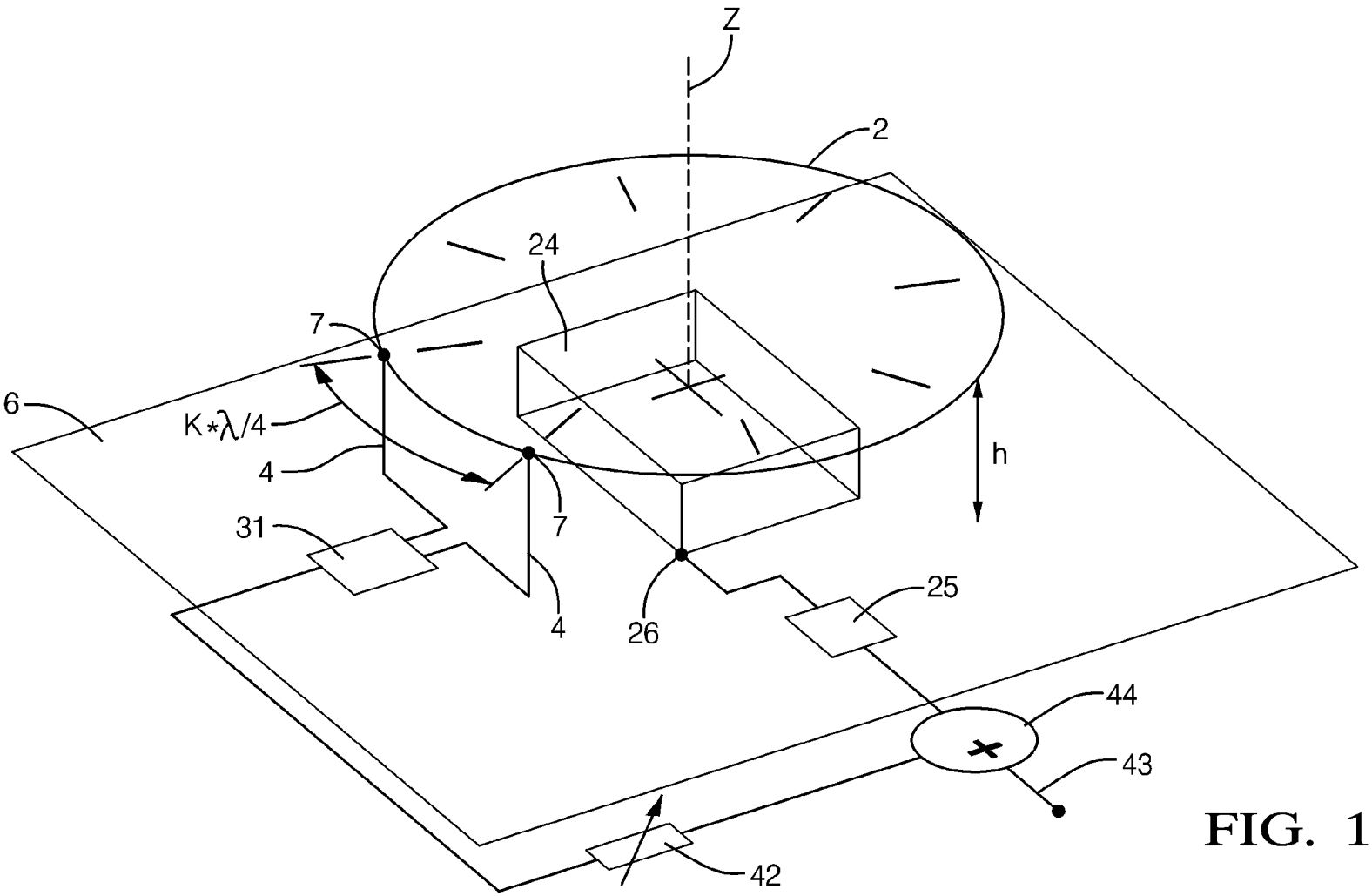
FIG. 13: is a loop emitter 2 according to the invention combined with a crossed emitter 24 with the same centre Z according to the state of the art with circular polarisation at higher angles of elevation, wherein the phase of its circular polarisation rotates with the azimuthal angle of the propagation factor in simple dependence. By superimposing on the received signals of the crossed emitter 24 the received signals of the loop emitter 2, of which the phase of circular polarisation is rotated with the azimuthal angle of the propagation factor in M-fold dependence, a directional aerial with a directional diagram with azimuthal main direction at the directional aerial connection 43 is formed.

As already stated above, in a loop emitter 2 with circular polarisation and azimuthal omnidirectional diagram according to the invention, the phase of the electromagnetic far field emitted rotates M times with the azimuthal angle of the propagation vector on account of the M current waves on the loop being propagated in one direction of travel. On account of the corresponding length of the loop structure, e.g. where M=2, two full wave trains of a travelling wave are formed. In FIG. 13, into the centre Z of a loop emitter 2, which by way of example is electrically excited via two λ/4-spaced coupling points 7, similarly to FIG. 2, is introduced a crossed emitter 24 with its centre Z in register, which at its emitter connection point 26 by definition similarly has an azimuthal omnidirectional diagram with circular polarisation. As also already described above, the crossed emitters 24 known from DE-A-4008505, DE-A-10163793 or EP 1 239 543 B1 and as patch aerials from the state of the art, as well as other known similar aerial forms on the principle of crossed emitters 24, fulfil the condition that the phase of circular polarisation rotates once with the azimuthal angle of the propagation vector—that is, with one complete azimuthal revolution through the angle 2π. In this particularly advantageous embodiment of the invention, the loop emitter 2 and the crossed emitter with the same centre Z are combined, so that the phase reference points of the two emitters are in register at the common centre Z. In case of superimposition of the received signals with suitable weighting and phase relationship of the loop emitter 2 and crossed emitter 24, according to the invention a directional aerial with a predetermined azimuthal main direction and elevation can be formed. This takes place due to the different azimuthal dependence of the phases of circularly polarised waves of the two emitters on the azimuthal angle of the propagation vector, wherein, depending on the phase position of the M current waves on the loop emitter 2, the emission is superimposed in some areas with facilitating or attenuating effect, depending on the azimuth angle of the propagation vector. By combining the signals of the loop emitter 2 with the crossed emitter with the correct amplitude via a controllable phase rotating element 42 and a summation network 44, in an advantageous manner in the azimuthal directional diagram of the combined aerial assembly at the directional aerial connection 43 a main direction of radiation is therefore formed, which depends on the adjustment of the phase rotating element 39. This property allows e.g. advantageous tracking of the main direction of radiation in mobile satellite reception.

Figure 14:
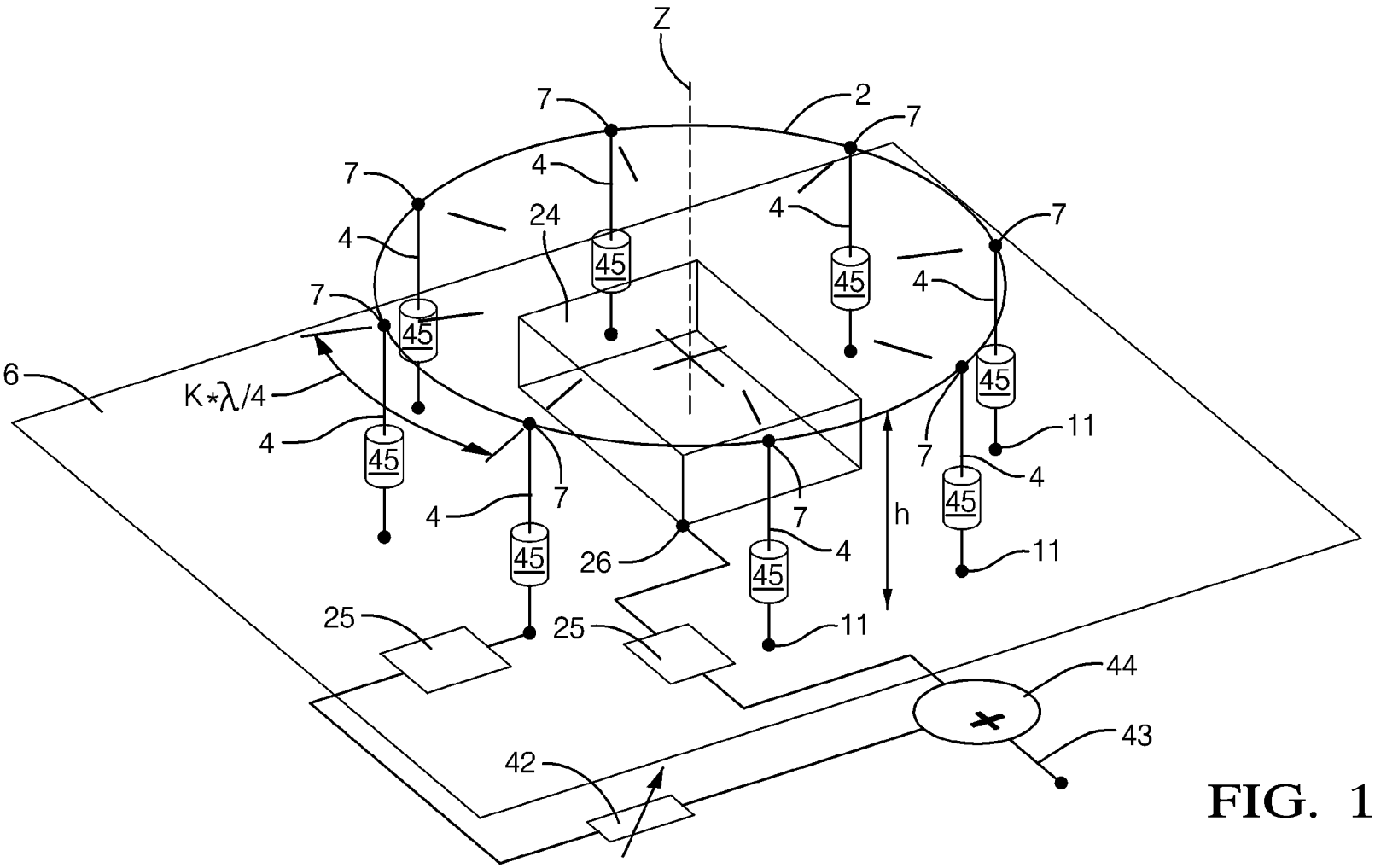
FIG. 14: is a directional aerial as in FIG. 13 with circular loop emitter 2 with N=8 vertical emitters 4 and M=2 full revolutions of the line wave, combined with a crossed emitter 24 with the same centre Z according to the state of the art. The vertical emitters 4 are distributed substantially equidistantly on the loop emitter 2 and arranged according to a phase difference of the travelling wave of in each case π/2. The received signals at the emitter connection point 46 of the loop emitter 2 and at the connection point of the crossed emitter 28 are superimposed by means of a controllable phase rotating element 42 in the summation network 44 to form the directional diagram with controllable azimuthal main direction.

In an advantageous embodiment of the invention according to FIG. 13, the loop emitter 2 is designed as a polygonal or circularly closed loop emitter 2 arranged rotationally symmetrically about the centre Z where M=2, extending in a horizontal plane at a height h above the conductive base surface 6. In FIG. 14 the loop emitter 2 with its vertical emitters 4 of a directional aerial of this kind is shown as a circle where M=2. The reactance circuits 45*a*-45*h* are designed in such a way that, in case of supply at the emitter connection point 46, the current distribution of a travelling line wave occurs, of which the phase difference over one revolution is 2*2π. Due to the action of the vertical emitters 4 coupled to the loop coupling points 7 with the reactance circuits 45*a*-45*h*, here too the developed length of the loop emitter 2*a* can be made shorter by a shortening factor of k<1 than the corresponding double wavelength 2λ. To reduce the diameter D of the loop emitter 2, the phase difference of 2*2π on the loop can take place by an increase in the line inductance and/or the line capacitance in relation to the conductive base surface 6. Depending on the above shortening factor k<1, the loop sections of the loop emitter 2 can be made substantially shorter than a quarter wavelength up to λ/8. In successive loop sections, accordingly high and low inductance values and low and high capacitance values of the loop sections alternate with each other. The received signals at the emitter connection point 46 of the loop emitter 2 and at the connection point of the crossed emitter 28 are superimposed via the controllable phase rotating element 42 in the summation and selection network 44 to form the directional diagram with controllable azimuthal main direction.

Figure 16:
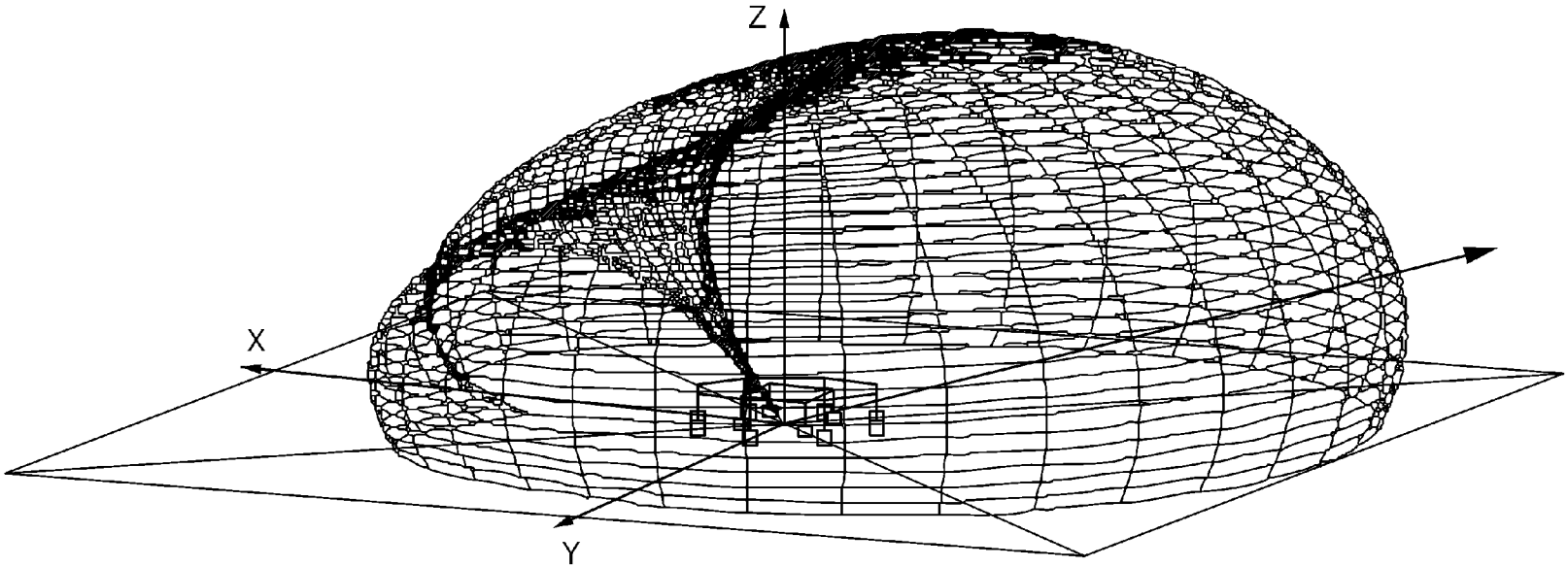
FIG. 16: is a three-dimensional directional diagram of the directional aerial in FIG. 15 with pronounced azimuthal main direction (arrow) and zero point.

In case of superimposition of the received signals with suitable weighting and phase relationship of the loop emitter and crossed emitter 24, according to the invention a directional aerial with a predetermined azimuthal main direction and elevation can be formed. This takes place due to the different azimuthal dependence of the current phases on the two emitters 2, 24, wherein, depending on the phase position of the current wave on the loop emitters 2 in relation to the phase of the crossed emitter 24, the emission is superimposed in some areas with facilitating or attenuating effect, depending on the azimuthal angle of the propagation vector. By combining the signals of the two emitters 2, 24 with correct amplitude via the controllable phase rotating element 42 and a summation network 44, in an advantageous manner in the azimuthal diagram of the combined aerial assembly a main direction of radiation is therefore formed at the directional aerial connection 43, which depends on the adjustment of the phase rotating element 39. This property allows e.g. advantageous tracking of the main direction of radiation in mobile satellite reception. The directive effect of superimposition of the received signals is apparent from the directional diagram shown in FIG. 16 for a LHCP-polarised satellite signal with adjustment of the phase rotating element 42. The main direction in azimuth with the low elevation is shown by an arrow.

Figure 15:
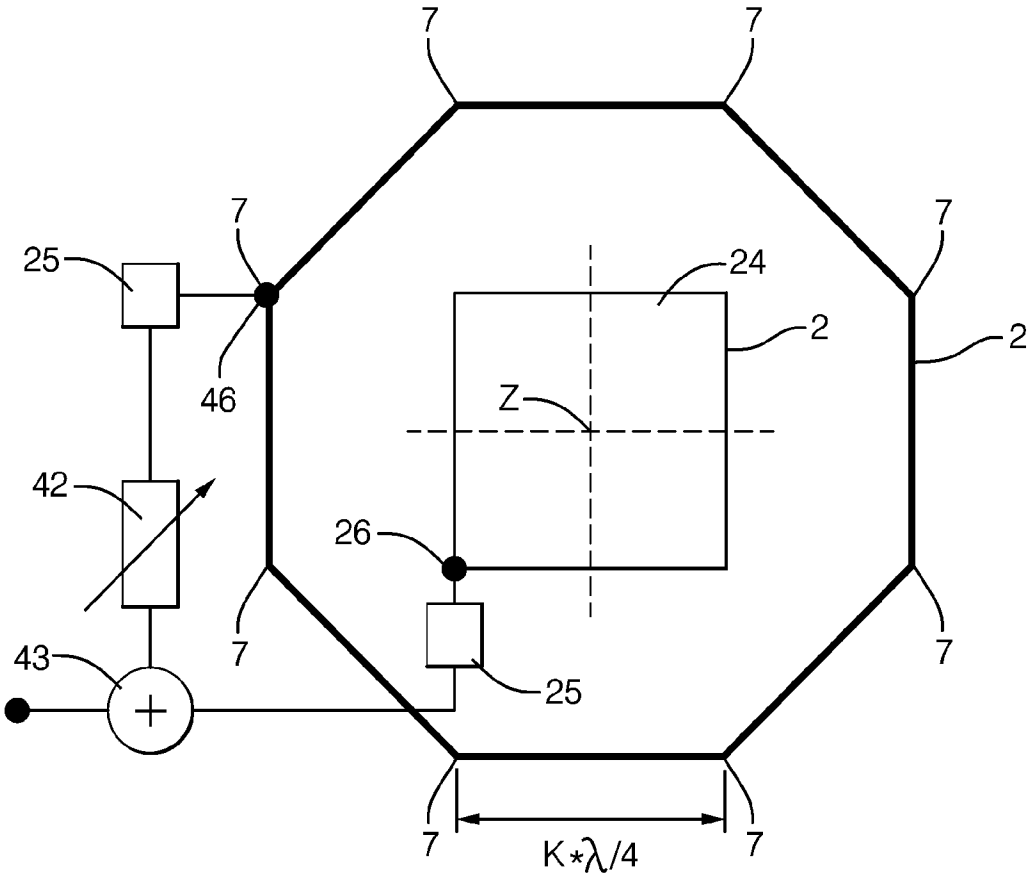
FIG. 15: is a directional aerial as in FIG. 14, but with octagonally shaped loop emitter 2 (phase difference of the travelling wave of 4π distributed over the circumference)

FIG. 15 shows a plan view of the directional aerial in FIG. 14, wherein the loop emitter 2 is formed as a substantially regular octagon, and the crossed emitter 24 is located centrally within the loop emitter 2. The loop coupling points 7 are in each case formed at the corners of the octagonal loop emitter 2. Connected to them in each case are the vertical emitters 4. Particularly with mobile satellite reception with only limited or partly shaded direct view of the satellite, on account of signal fading occurring suddenly it is frequently advantageous to increase the multiplicity of received signals available for selection, for example for the purposes of a switching diversity process. By designing the summation network 44 as a summation and selection network 44*a*, it is possible there to choose separately both between the received signals of the two emitters 2, 24 and the weighted superimposition—if occasion arises with different weightings.

It is to be understood that the invention has been described with reference to specific embodiments and variations to provide the features and advantages previously described and that the embodiments are susceptible of modification as will be apparent to those skilled in the art.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not to be in any way limiting, the invention, which is defined by the following claims as interpreted according to the principles of patent law, including the Doctrine of Equivalents, may be practiced otherwise than as specifically described.

We claim:

1. An aerial operative to receive circularly polarised satellite radio signals, said aerial comprising:

at least one substantially horizontally oriented conductor loop arranged over a conductive base surface and an assembly for electromagnetic excitation of the conductor loop connected to an aerial connection, wherein the conductor loop is configured as a loop emitter by a polygonal or circularly closed loop extending in a substantially horizontal plane of height h above the conductive base surface, the loop emitter forms a resonant structure and is electrically excited by the electromagnetic exciter whereby on the loop the current distribution of a travelling line wave occurs in one direction of rotation, of which the phase difference over one revolution is $M*2\pi$, where M is an integer and has at least a value of M=2, to facilitate the vertically oriented fractions of the electromagnetic field, there is at least one emitter extending vertically at the circumference of the loop emitter and to the conductive base surface and which is electromagnetically coupled to both the loop emitter (2) and the electrically conductive base surface, and the height h is lower than ⅕ of the free-space wavelength $\lambda$, wherein over the circumference of length (L) of the loop emitter, several (N) vertical emitters, spaced apart from each other as sections of the structure at approximately equal intervals of the developed length (L/N), are coupled via loop coupling points to the loop emitter on the one hand and on the other hand via earth connection points, and by the design of the vertical emitters both the resonance of the loop emitter designed as a resonant structure and the direction of travel of the line wave on the loop emitter caused by electromagnetic excitation are facilitated, wherein to produce the resonance of the loop emitter, at least one of the vertical emitters is connected at an interruption point to a low-loss reactance circuit having the reactance X necessary therefor, wherein the coupling of the vertical emitter to the earth connection point is capacitive, and the necessary reactance X of the low-loss reactance circuit is provided by the design of this capacitive coupling, and wherein the reactance circuits constructed as capacitances are formed in such a way that the vertical emitters are formed at their lower ends into individually shaped planar capacitance electrodes, and by interposition of a dielectric plate between the latter and the electrically conductive base surface constructed as an electrically conductively coated printed circuit board, the capacitances are designed for coupling three vertical emitters to the electrically conductive base surface, and for capacitive coupling of the fourth vertical emitter to the aerial connection, the latter is designed as a planar counterelectrode isolated from the conductive layer.

2. The aerial of claim 1, wherein the developed length L of the loop emitter which is in resonance is shortened by the action of the vertical emitters, from approximately M times the line wavelength, to approximately one-half M times the line wavelength.

3. The aerial of claim 1, wherein the loop emitter is configured circularly with the centre Z, and electromagnetic excitation for generating a continuous line wave on the loop emitter is affected by two loop coupling points spaced apart from each other along the loop structure by essentially 1/(4*M) of the developed line length L, at which coupling points signals of equal quantity which are shifted in phase from each other by 90° are supplied via vertical emitters connected to the closed loop and extending to the conductive base surface.

4. The aerial of claim 1, wherein to generate a continuous line wave on the loop emitter, N loop coupling points spaced apart from each other along the loop structure by essentially L/N each are formed, and electromagnetic excitation is formed by the fact that, by connection of vertical emitters which extend to the electrically conductive base surface at the loop coupling points of the closed loop, signals of equal quantity which are shifted in phase by M*360°/N from each other are supplied.

5. The aerial of claim 1, wherein the loop emitter where M=2 is designed as a closed ring having rectilinear sections with an edge length of substantially L/8 above the conductive base surface at a distance h above the conductive base surface, and to generate a continuous line wave on the loop emitter and for contactless coupling to the loop emitter, the electromagnetic exciter is formed by a ramp-like directional coupling conductor with an advantageous horizontal extent of essentially L/8, which, starting from the aerial connection located on the conductive base surface, extends via a vertical supply line, except for a coupling distance, to one of the ends of a section of the loop emitter, from there encounters the base surface approximately below the end of an adjacent section substantially with a ramp function, and is conductively connected to the base surface via the earth connection point.

6. The aerial of claim 5, wherein, the loop emitter where M=2 is substantially square-shaped, at its corners and centrally between adjacent corners in each case a loop coupling point with a vertical emitter electrically connected there is formed, and there are vertical emitters each with a reactance circuit constructed as a capacitance for coupling to the earth connection point on the electrically conductive base surface.

7. The aerial of claim 1, wherein to facilitate the horizontally polarised fractions of the radiation field at the loop coupling points, horizontal emitter elements are coupled, which at their other ends merge with the vertical emitters.

8. The aerial of claim 1, wherein the loop emitter where M=2 is substantially round and, distributed equidistantly over the circumference at least 8 points, in each case a loop coupling point with a vertical emitter electrically connected there is formed, and there are vertical emitters each with a reactance circuit constructed as a capacitance for coupling to the earth connection point on the electrically conductive base surface.

9. The aerial of claim 1, wherein, electromagnetic excitation is provided by partial coupling to one of the vertical emitters at one of the loop coupling points, and in connection therewith the unidirectionality of wave propagation on the loop emitter is caused by the impedance of the section of the loop emitter to the adjacent loop coupling point necessary for cancellation of waves in the opposite direction of rotation and referred to the conductive base surface, by contrast with the impedance of the respectively adjacent section of the loop emitter.

10. The aerial of claim 1, wherein, electromagnetic excitation is provided via the connection to one of the vertical emitters with the reactance circuit constructed as a capacitance in such a way that the vertical emitter is coupled not to the earth connection point to the electrically conductive base surface, but to the aerial connection formed on the plane of the conductive base surface.

11. The aerial of claim 1, wherein, facilitation of unidirectionality of wave propagation on the loop emitter is provided by alternately differing design of the impedances of the sections succeeding each other in the direction of rotation between adjacent loop coupling points, in combination with fine adjustment of the unidirectionality of wave propagation by slightly different lengths of the sections.

12. The aerial of claim 1, wherein the conductive structure, consisting of the loop and the vertical emitters connected thereto, is fixed by a dielectric supporting structure in such a way that the dielectric plate is constructed in the form of an air gap.

13. The aerial of claim 1, wherein the reactance circuit is of multi-frequency design such that both the resonance of the loop emitter and the required direction of travel of the line wave on the loop emitter are provided in frequency bands separate from each other.

14. The aerial of claim 1, wherein the conductive base surface, which extends substantially in a base surface plane E1, at the site of the loop emitter is formed as an open-topped conductive cavity of which the conductive cavity base surface extends in a base surface plane E2 located at a distance h1 parallel to and below the base surface plane E1, and into which the loop emitter, extending in a further horizontal loop plane E at height h, is introduced over the cavity base surface, and the conductive cavity base surface at least covers the vertical projection surface of the loop emitter onto the base surface plane E2 located below the conductive base surface plane E1, and the cavity side surfaces at each point have a contour such that, with the required frequency bandwidth of the aerial, an adequate cavity distance is provided at each point between the loop emitter and the cavity.

15. The aerial of claim 1, wherein there is a crossed emitter of which the centre is in register with the centre of the loop emitter and of which the phase of circular polarisation rotates once with the azimuthal angle of the propagation vector, that is, in one complete azimuthal revolution by an angle of $2\pi$, and of which the received signals have superimposed on them the received signals of the loop emitter in a summation network to form a directional aerial with a directional characteristic of which the main direction can be selected.

16. The aerial of claim 15, wherein the phase difference of the line wave being propagated in only one direction of rotation on the loop emitter designed where M=2 is $2*2\pi$ over one revolution, and the received signals at its emitter connection point are conducted via a controllable phase rotating element and delivered to the summation network and there weighted and added to the received signals of the crossed emitter which are also delivered to the summation network, at its emitter connection point, to form the main direction in the azimuthal directional diagram, so that by variable adjustment of the phase rotating element the azimuthal main direction of the directional aerial is adjusted variably at the directional aerial connection.

17. The aerial of claim 16, wherein the loop emitter where M=2 as a closed, regular, substantially octagonal loop having an edge length of substantially L/8 extends at a distance h above the conductive base surface, and at each of its corners are formed loop coupling points for coupling the vertical emitters.

18. The aerial of claim 17, wherein by design of the summation network as a summation and selection network, both the received signals of the two emitters separately and in each case differently weighted superimposed arrangements of the received signals of the two emitters are available for selection for the purposes of a switching diversity process, and so the multiplicity of received signals which can be retrieved at the directional aerial connection is increased.

19. The aerial of claim 15, wherein the crossed emitter is formed by a patch aerial for circular polarisation.

20. The aerial of claim 1, wherein for the design of a multi-band aerial, apart from the loop emitter with centre Z designed for a first frequency, there is at least a second concentric loop emitter, having a characteristic resonance at a second frequency.

* * * * *